US011279134B2

(12) United States Patent
Kobashi et al.

(10) Patent No.: US 11,279,134 B2
(45) Date of Patent: Mar. 22, 2022

(54) LIQUID EJECTION APPARATUS

(71) Applicant: SEIKO EPSON CORPORATION, Tokyo (JP)

(72) Inventors: Masaru Kobashi, Matsumoto (JP); Tomoyoshi Hirabayashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/911,940

(22) Filed: Jun. 25, 2020

(65) Prior Publication Data

US 2020/0406621 A1 Dec. 31, 2020

(30) Foreign Application Priority Data

Jun. 28, 2019 (JP) ..... JP2019-122286

(51) Int. Cl.
*B41J 2/165* (2006.01)
*B41J 2/155* (2006.01)
*B41J 11/00* (2006.01)

(52) U.S. Cl.
CPC ..... *B41J 2/155* (2013.01); *B41J 2/16505* (2013.01); *B41J 2/16535* (2013.01); *B41J 11/003* (2013.01); *B41J 11/0095* (2013.01); *B41J 2202/21* (2013.01)

(58) Field of Classification Search
CPC ..... B41J 2/16523; B41J 2/16505; B41J 2002/16529; B41J 2002/16597
See application file for complete search history.

(56) References Cited

U.S. PATENT DOCUMENTS

2011/0234671 A1 9/2011 Suzuki
2014/0184675 A1 7/2014 Tamaki
2014/0240395 A1* 8/2014 Shindo ..... B41J 2/16505 347/29
2016/0152030 A1* 6/2016 Nawano ..... B41J 2/1652 347/30
2016/0214385 A1 7/2016 Tsunemi et al.
2017/0173962 A1* 6/2017 Mizuno ..... B41J 2/16523
2018/0244065 A1* 8/2018 Horade ..... B41J 2/16526

FOREIGN PATENT DOCUMENTS

JP 2011-194764 10/2011
JP 2014-128954 7/2014
JP 2016-137616 8/2016

* cited by examiner

*Primary Examiner* — Jason S Uhlenhake
(74) *Attorney, Agent, or Firm* — Workman Nydegger

(57) ABSTRACT

A liquid ejection apparatus includes a liquid ejection head configured to eject liquid from a plurality of nozzles to a medium and a plurality of caps configured to cover a plurality of nozzle groups. The plurality of caps includes a first cap group covering a first nozzle group positioned near the center of the liquid ejection head among the plurality of nozzle groups and a second cap group and a third cap group provided at positions sandwiching the first cap group in the width direction. The liquid ejection head is configured to execute a first idle ejection for ejecting liquid from the plurality of nozzles constituting the plurality of nozzle groups to the plurality of caps and a second idle ejection for ejecting the liquid from the plurality of nozzles constituting the second nozzle group and the third nozzle group to the second cap group and the third cap group.

11 Claims, 10 Drawing Sheets

FIG. 12

RD

| MEDIUM SIZE | SECOND NOZZLE GROUP NG2 | FIRST NOZZLE GROUP NG1 | THIRD NOZZLE GROUP NG3 |
|---|---|---|---|
| MS1 | 2 | 8 | 2 |
| MS2 | 2 | 8 | 2 |
| MS3 | 3 | 6 | 3 |
| MS4 | 3 | 6 | 3 |
| MS5 | 3 | 6 | 3 |
| MS6 | 4 | 4 | 4 |
| MS7 | 4 | 4 | 4 |
| MS8 | 5 | 2 | 5 |

LIQUID EJECTION APPARATUS

The present application is based on, and claims priority from JP Application Serial Number 2019-122286, filed Jun. 28, 2019, the disclosure of which is hereby incorporated by reference herein in its entirety.

BACKGROUND

1. Technical Field

The present disclosure relates to a liquid ejection apparatus including a liquid ejection head that ejects liquid onto a medium such as paper.

2. Related Art

In the related Art, as a liquid ejection apparatus of this type, an ink jet printer that performs printing on a medium such as paper by ejecting liquid such as ink from a plurality of nozzles included in a liquid ejection head is widely known. For example, JP-A-2011-194764 discloses an ink jet line printer as a liquid ejection apparatus. In the line printer, when a size of the medium is smaller than the maximum size that can be printed by the line printer, unused nozzles are generated at both end portions corresponding to a widthwise outside area of the medium in the liquid ejection head. Among the nozzles corresponding to a printing area of the medium, a nozzle that ejects liquid less frequently may exist. For that reason, for example, idle ejection in which liquid unrelated to printing is ejected from the nozzle of the liquid ejection head toward a cap or the like at regular intervals is performed.

By performing capping that covers the area including the nozzles of the liquid ejection head with a cap during standby when printing is not performed, viscosity of liquid such as ink in the nozzle is suppressed from increasing. Under the capping state, an increase in viscosity of the liquid in the nozzle is suppressed due to moisture such as water vapor evaporated from waste liquid attached or accumulated in the cap.

However, in the line printer described in JP-A-2011-194764, when printing is performed on a medium having a width smaller than the maximum width that the line printer can print, the nozzles at the printing area where the liquid in the nozzles are refreshed each time by ejecting the liquid during printing, whereas the nozzles at both end areas that are not used for printing eject only the liquid increased in viscosity due to evaporation of moisture even if the nozzles periodically perform the idle ejection. For that reason, in the nozzles at both end areas, moisture in the cap is insufficient, and moisturizing ability of the nozzle is reduced.

In the liquid increased in viscosity, a ratio of water used as a solvent or a dispersion medium to a moisturizing component in the liquid such as ink is low. That is, waste liquid in the cap has a high concentration of the moisturizing component. If the concentration of the moisturizing component in the waste liquid in the cap is high, a difference in the concentration of the moisturizing component between the waste liquid in the cap and the liquid in the nozzle occurs. For that reason, the moisturizing component in the waste liquid in the cap deprives the liquid in the nozzle of moisture so that the concentrations of the moisturizing components become the same. As a result, there is a problem that the liquid in the nozzle becomes more viscous even though the liquid ejection head is being capped.

SUMMARY

According to an aspect of the present disclosure, there is provided a liquid ejection apparatus including a liquid ejection head configured to extend in a width direction that intersects a transport direction of a medium and eject liquid to the medium from a plurality of nozzles constituting a plurality of nozzle groups and a plurality of caps configured to cover the plurality of nozzle groups, in which the plurality of caps includes a first cap group covering a first nozzle group positioned near the center of the liquid ejection head among the plurality of nozzle groups and a second cap group and a third cap group provided at positions sandwiching the first cap group in the width direction and the liquid ejection head is configured to execute a first idle ejection for ejecting liquid from the plurality of nozzles constituting the plurality of nozzle groups to the plurality of caps and a second idle ejection for ejecting the liquid from the plurality of nozzles constituting the second nozzle group and the third nozzle group to the second cap group and the third cap group.

BRIEF DESCRIPTION OF THE DRAWINGS

FIG. 12 is a schematic diagram illustrating reference data.

DESCRIPTION OF EXEMPLARY EMBODIMENTS

Hereinafter, an embodiment of a medium reading device will be described.

An embodiment of an ink jet printer, which is a type of printing apparatus, will be described below with reference to the accompanying drawings.

A liquid ejection apparatus 11 is placed on a horizontal plane, and the width direction and the depth direction are thereof substantially horizontal. The vertical direction is indicated by the Z-axis, the direction in which a medium is transported at a printing position inside the apparatus is indicated by the Y-axis, and the X-axis intersecting the Z-axis and the Y-axis are indicated, respectively. The X-axis, the Z-axis, and the Y-axis are coordinate axes indicating lengths of the width, height, and depth, respectively. When focusing on the medium transported during printing, the X-axis parallel to the width direction of the medium, and the Y-axis parallel to the transport direction when the medium moves at the printing position where the liquid is ejected, are also hereinafter referred to as the width direction X and the transport direction Y.

Figure 1:
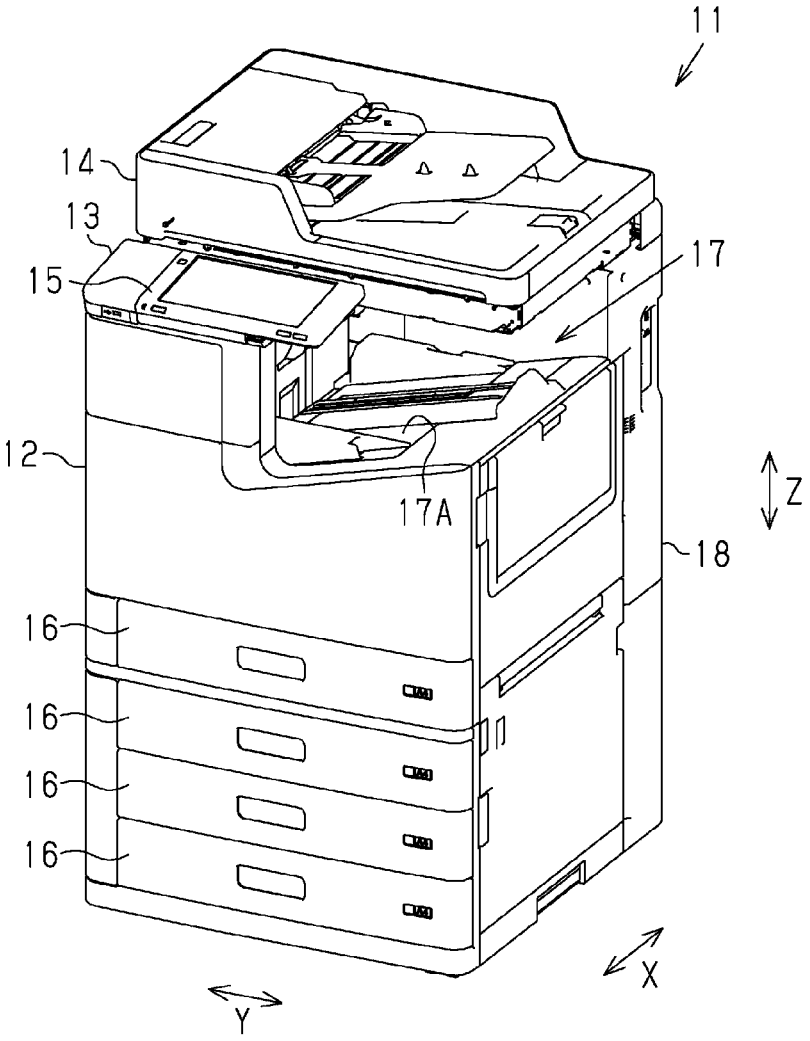
FIG. 1 is a perspective view illustrating a liquid ejection apparatus according to an embodiment.

As illustrated in FIG. 1, the liquid ejection apparatus 11 includes a main body portion 12 having a rectangular parallelepiped shape, and an image reading section 13 and an automatic feeding section 14 attached to an upper portion of the main body portion 12. The liquid ejection apparatus 11 has a configuration in which the main body portion 12, the image reading section 13, and the automatic feeding section 14 are stacked in order from the lower side in the vertical direction Z. The image reading section 13 is configured to be able to read images such as characters and photographs recorded on a document. The automatic feeding section 14 is configured to be able to feed the document toward the image reading section 13. The image reading section 13 includes an operation section 15 operated when giving an instruction to the liquid ejection apparatus 11. The operation section 15 includes, for example, a touch panel-type liquid crystal screen, operation buttons, and the like. The main body portion 12 includes a plurality of medium storing portions 16 that can store a medium M such as paper (see FIG. 2). The main body portion 12 in this embodiment includes a total of four medium storing portions 16. The medium storing portion 16 is configured to be able to be pulled out from the main body portion 12. The main body portion 12 includes a placement portion 17 on which the medium M on which printing is performed in the main body portion 12 is placed. The placement portion 17 has a placement surface 17A on which the medium M is placed. Only one medium storing portion 16 may be provided.

Figure 2:
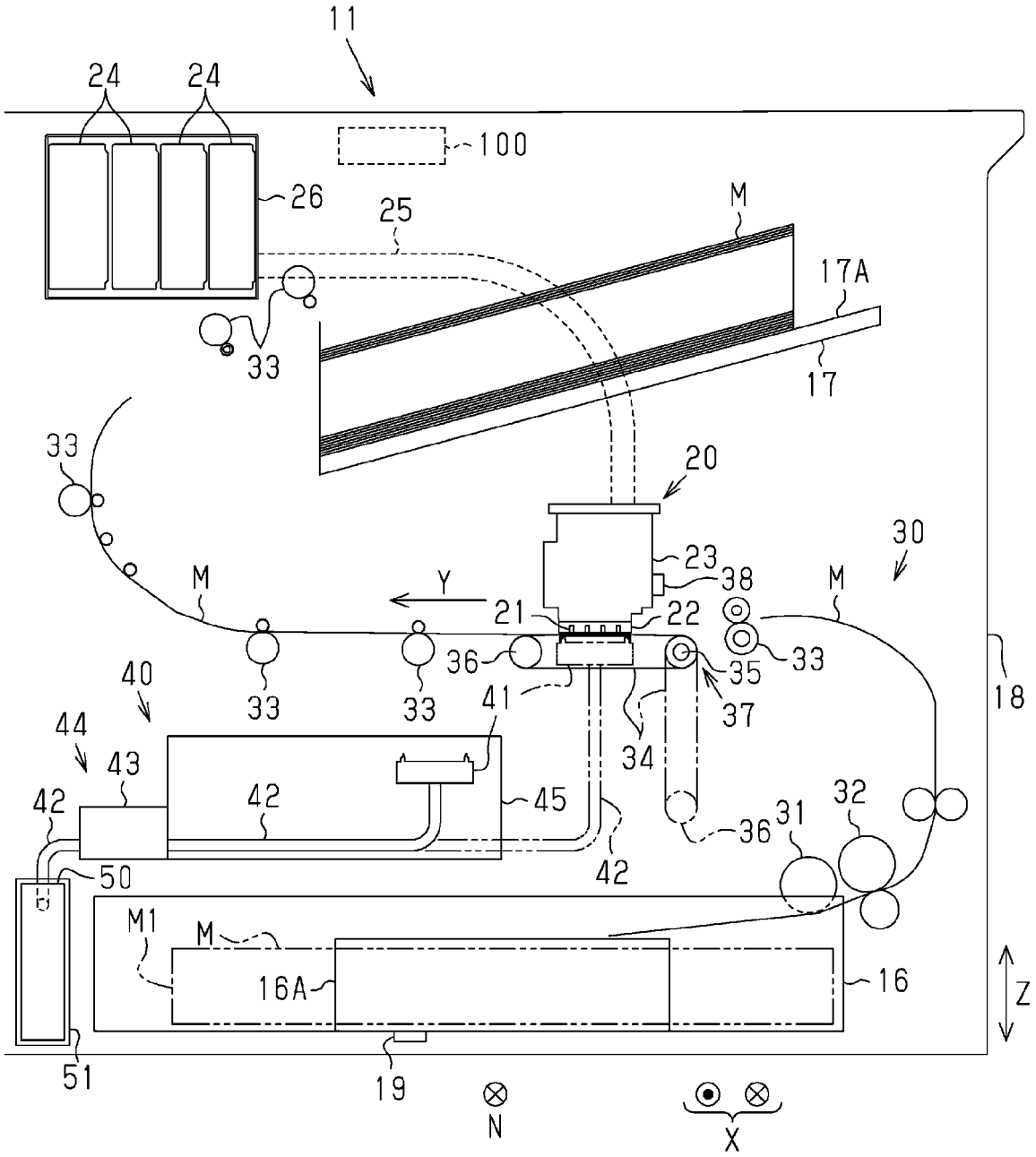
FIG. 2 is a front cross-sectional view illustrating the liquid ejection apparatus.

Next, an internal configuration of the liquid ejection apparatus 11 will be described with reference to FIG. 2. As illustrated in FIG. 2, the main body portion 12 of the liquid ejection apparatus 11 includes a substantially rectangular parallelepiped casing 18. The liquid ejection apparatus 11 includes a head section 20, a transport section 30 that transports the medium M, and a control section 100 that controls these components in the casing 18. The head section 20 includes a liquid ejection head 22 in which a plurality of nozzles 21 capable of ejecting liquid droplets are opened, and a support portion 23 that holds the liquid ejection head 22 at a predetermined height in the casing 18.

The liquid ejection head 22 is supported by the support portion 23 in a state of extending in the width direction X intersecting the transport direction Y of the medium M. The liquid ejection head 22 is configured to eject liquid to the medium M from a plurality of nozzles 21 constituting a plurality of nozzle groups. The liquid ejection head 22 is connected to a supply flow path 25 for supplying the liquid in a liquid container 24. A plurality of liquid containing bodies 24 are mounted on a holder 26 in the casing 18. The plurality of liquid containing bodies 24 each contains a different type of liquid. In an example in which the liquid is ink, the plurality of liquid containing bodies 24 each contains ink of a different color. In this example, the plurality of liquid containing bodies 24 contain black ink and color ink, respectively. For example, when the number of the liquid containing bodies 24 mounted on the holder 26 is four, four liquid containing bodies 24 contain ink of black, yellow, cyan, and magenta, respectively. Here, in this example, three colors of yellow, cyan and magenta of ink corresponds to an example of the color ink. The number of the liquid containing bodies 24 can be changed as appropriate, and a configuration in which five to ten liquid containing bodies contain five to ten different colors ink may be adopted. Alternatively, a configuration in which two or three liquid containing bodies 24 containing two or three different colors of ink are mounted may be adopted. Furthermore, a configuration in which only one liquid container 24 is mounted may be adopted.

Assuming that a position where the liquid ejection head 22 ejects the liquid is a recording position, printing is performed by ejecting the liquid from the nozzle 21 toward the medium M at the recording position. The liquid ejection head 22 is configured to eject black ink as an example of liquid and color ink different from black ink. That is, the liquid ejection apparatus 11 is a color ink jet printer, and is configured to be capable of monochrome printing and color printing. During monochrome printing, the liquid ejection head 22 ejects black ink from the nozzle 21 toward the medium M. During color printing, the liquid ejection head 22 ejects color ink from the nozzle 21 toward the medium M. In this example, during color printing, the liquid ejection head 22 ejects ink of three colors of yellow, cyan, and magenta from the nozzle 21 toward the medium M, or ejects ink of four colors, which is obtained by adding black ink to the ink of three colors, from the nozzle 21 toward the medium M. In any case, during color printing, color ink is ejected. The monochrome printing here includes gray scale printing.

The transport section 30 includes a feed roller 31, which feeds the medium M one by one from the highest medium M from a group of the media M stacked in the medium storing portion 16, a separation roller 32 for separating the medium M into a single sheet of the medium M when a plurality of sheets of the medium M are fed, a plurality of transport rollers 33 that transport the medium M along a transport path that is a path passing through the recording position, and a transport belt 34 that transports the medium M at the recording position.

The transport belt 34 is wound around a first roller 35 and a second roller 36. The transport belt 34 is configured to be rotatable around the first roller 35 as a fulcrum. The transport belt 34 moves between a support position indicated by a solid line in FIG. 2 and a retracted position indicated by a two-dot chain line in FIG. 2. The transport belt 34 supports the medium M being transported at the support position. That is, the transport belt 34 has a function of a support portion that supports the medium M so as to keep the gap between the medium M being transported and the liquid ejection head 22 constant. The transport belt 34 functioning as the support portion moves between the support position and the retracted position by a support portion moving mechanism 37. Here, the transport direction Y refers to the transport direction of the medium M at the recording position.

As illustrated in FIG. 2, the liquid ejection apparatus 11 includes a size sensor 19 that detects the size of the medium M stored in the medium storing portion 16. A movable edge guide 16A operated by a user to set the medium M at a predetermined position is provided in the medium storing portion 16. The size sensor 19 detects the position of the edge guide 16A when the edge guide 16A is applied to the side end face of the medium group M1 on which the medium M is stacked and the medium M is positioned in the width direction in the medium storing portion 16. A rack and pinion mechanism is provided below the edge guide 16A. When replacing the medium M in the medium storing portion 16, the user operates and moves the edge guide 16A.

In this case, the position of the rack moves as the pinion rotates with the movement of the edge guide 16A. The size sensor detects the size of the medium M by detecting the movement position of the rack. The control section 100 acquires the medium size according to the position of the rack detected by the size sensor.

Each of the plurality of medium storing portions 16 illustrated in FIG. 1 is individually provided with the size sensor 19 for detecting the size of the medium M stored therein. The size sensor 19 that detects the size of the medium M is not limited to a configuration in which the medium size is detected from the position of the edge guide 16A that positions the medium M stored in the medium storing portion 16. For example, a contact-type sensor or a non-contact-type sensor configured to be able to detect the width of the medium M in the medium storing portion 16 may be used.

The control section 100 can acquire the largest width (maximum width) and the smallest width (minimum width) among the widths of the plurality of types of media M stored in the plurality of medium storing portions 16 based on detection signals from the plurality of size sensors 19 provided in the plurality of medium storing portions 16. When instructing the liquid ejection apparatus 11 to perform printing, the user inputs information such as a medium type, a medium size, a tray number, and a printing color as printing condition information by operating the operation section of the liquid ejection apparatus 11 or operating an operation section of a host device communicably connected to the liquid ejection apparatus 11.

The control section 100 recognizes the size of the medium M stored in the medium storing portion 16 for each medium storing portion 16. For example, when a "tray number" is specified as information for designating the medium M in the printing condition information, the control section 100 can acquire the size of the medium M stored in the medium storing portion 16 corresponding to the tray number. The medium size information in the printing condition information may be used, but set or designated medium size information and the size of the medium M actually stored in the medium storing portion 16 may be different. For that reason, in the embodiment, by detecting the medium M stored in the medium storing portion 16 directly or indirectly with the size sensor 19, accurate width information on the medium M used for printing is acquired.

The liquid ejection head 22 ejects liquid onto the medium M. The liquid ejection head 22 according to the embodiment is a line head including a number of nozzles 21 capable of simultaneously ejecting the liquid over the entire width of the medium M in the width direction X intersecting (in the embodiment, orthogonal to) the transport direction Y and the ejection direction Z. The liquid ejection apparatus 11 performs line printing by ejecting liquid from a plurality of nozzles 21 at positions facing the entire width of the medium M, toward the medium M transported at a constant speed corresponding to a printing mode.

The liquid container 24 is, for example, a liquid cartridge detachably mounted on a holder 26 for the supply source included in the liquid ejection apparatus 11. The liquid container 24 may be a liquid tank into which liquid is injected from a liquid container such as a bottle in a state of being mounted on the holder 26.

The liquid ejection apparatus 11 includes the medium storing portion 16 that can store a plurality of media M before printing, the placement portion 17 on which the printed medium M discharged to the outside of the casing 18 is placed in a stacked state, a maintenance section 40 that performs maintenance of the liquid ejection head 22, and a waste liquid container 50 that contains waste liquid generated with maintenance of the liquid ejection head 22 and the like. The waste liquid container 50 is detachably mounted on a holder 51 for waste liquid. The waste liquid container 50 mounted on the holder 51 is disposed at a predetermined position in the casing 18. The medium storing portion 16 is, for example, a cassette, and is detachably inserted into the casing 18 by being inserted, in an insertion direction N, into a recess (not illustrated) formed in the casing 18. In the state illustrated in FIG. 2 in which the medium storing portion 16 is inserted into the casing 18, the medium M stored in the medium storing portion 16 is positioned inside the casing 18. In FIG. 2, only the uppermost one of the plurality of medium storing portions 16 is illustrated, and the others are omitted.

In the liquid ejection apparatus 11, the liquid ejection head 22 performs maintenance operations such as idle ejection, capping, and suction cleaning in order to prevent or eliminate ejection failures caused by clogging of the nozzles 21 or attachment of foreign matter.

The maintenance section 40 includes a plurality of caps 41 configured to cover the plurality of nozzle groups, a discharge mechanism 44 for discharging the liquid in the cap 41, and a cap moving mechanism 45 for moving the cap 41. The discharge mechanism 44 includes a waste liquid flow path 42 connecting the cap 41 and the holder 51, and a depressurization section 43 provided in the waste liquid flow path 42. The liquid ejection apparatus 11 includes the waste liquid container 50 that contains the waste liquid discharged from the cap 41 by the discharge mechanism 44.

The cap moving mechanism 45 moves the cap 41 between a retracted position illustrated by a solid line in FIG. 1 and a capping position (illustrated by a two-dot chain line in FIG. 1) in contact with a nozzle surface 28 of the liquid ejection head 22. When the cap 41 moves to the capping position, the transport belt 34 retreats from the support position illustrated by the solid line in FIG. 1 to the retracted position illustrated by the two-dot chain line in FIG. 1.

When the cap 41 is moved to the capping position and comes into contact with the nozzle surface 28 of the liquid ejection head 22 so as to surround the nozzle 21, capping is performed. When the liquid is not ejected, capping is performed to prevent the liquid in the nozzle 21 from increasing in viscosity, thereby preventing occurrence of ejection failure.

Here, the idle ejection refers to a maintenance ejection operation for ejecting (discharging) droplets not related to printing from the nozzle 21 for the purpose of maintaining the liquid ejection head 22. The idle ejection is also called flushing. By performing the idle ejection, ink increased in viscosity, bubbles, or foreign matter that causes the ejection failure is discharged from the nozzle 21. The liquid discharged as waste liquid by the idle ejection is contained by the cap 41. Specifically, the cap 41 is disposed at the capping position during the flushing time, during the maintenance time, and at the end of printing. At the time of idle ejection, the liquid ejection head 22 ejects droplets from the nozzle 21 toward the cap 41, thereby performing idle ejection.

Cleaning is performed by driving the depressurization section 43 in a state where the cap 41 is disposed at the capping position. The cleaning in this example is suction cleaning in which the liquid is suctioned and discharged from the nozzle 21 by making a substantially closed space between the nozzle surface 28 and the cap 41 to a negative pressure. The waste liquid flow path 42 is connected to one end portion of the cap 41 opposite to the opening. The other end of the waste liquid flow path 42 is connected to the holder 51 via the depressurization section 43. The waste liquid container 50 is detachably mounted on the holder 51. That is, the cap 41 communicates with the waste liquid container 50 via the waste liquid flow path 42, the depressurization section 43, and the holder 51.

The liquid discharged from the nozzle 21 by the cleaning is contained in the waste liquid container 50 as waste liquid through the waste liquid flow path 42 connected to the cap 41. When a predetermined amount of waste liquid discharged from the nozzle 21 due to idle ejection accumulates in the cap 41, the liquid in the cap 41 is collected in the waste liquid container 50 through the waste liquid flow path 42 by driving the depressurization section 43 in a state where the cap 41 is separated from the liquid ejection head 22 by a predetermined gap distance. This suction is called idle suction. The idle suction is performed to discharge the liquid accumulated in the cap 41.

As illustrated in FIG. 2, the waste liquid container 50 is disposed, for example, on the side of the medium storing portion 16. The waste liquid container 50 is inserted into the casing 18 by opening a cover provided on the front side which is on the front side of the paper surface of FIG. 2 and pushing the waste liquid container 50 from an insertion port (both not illustrated) toward the back side. The insertion direction is the width direction X of the medium M. The waste liquid container 50 has, for example, a rectangular parallelepiped shape having a predetermined length in one direction, and is inserted in a direction in which the longitudinal direction thereof is the width direction X. In this example, the holder 51 is disposed at the rear part of the casing 18 which is on the back side in the insertion direction of the waste liquid container 50. In a state where the waste liquid container 50 is mounted on the holder 51, the waste liquid flow path 42 is connected to a supply port of the waste liquid container 50 via the holder 51.

Figure 3:
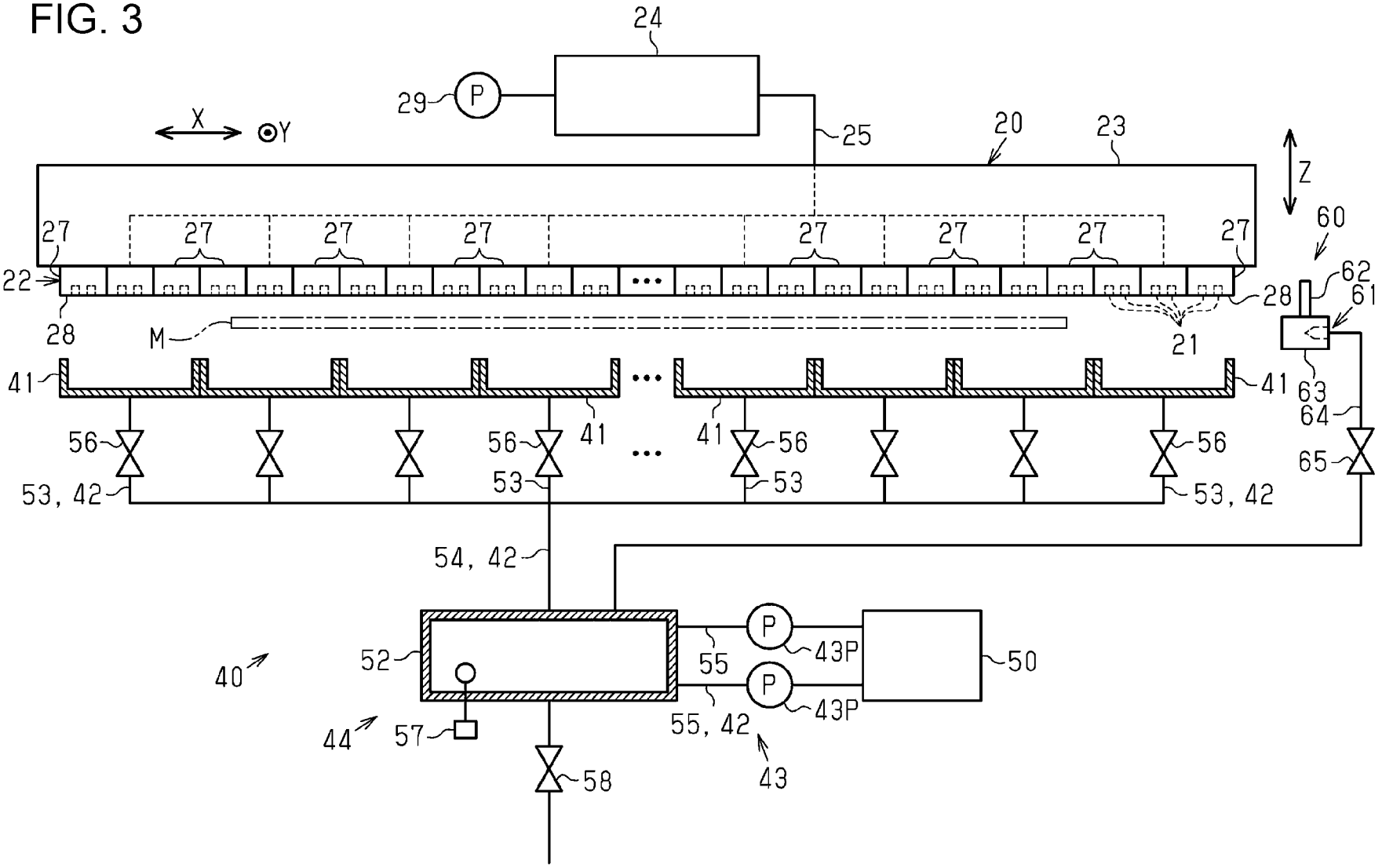
FIG. 3 is a schematic cross-sectional view illustrating a maintenance section.

Next, with reference to FIG. 3, a configuration of the maintenance section 40 for maintaining the nozzle 21 of the liquid ejection head 22 will be described. As illustrated in FIG. 3, the liquid ejection head 22 of the line printing system includes a plurality of unit ejection heads 27. The plurality of unit ejection heads 27 are held by the support portion 23. The plurality of unit ejection heads 27 are disposed side by side in the width direction X. In this embodiment, the number of unit ejection heads 27 is thirty-six. The unit ejection head 27 includes a plurality of nozzles 21. The unit ejection head 27 includes a plurality of types of nozzles 21 capable of ejecting liquids of a plurality of colors corresponding to the number of the liquid containing bodies 24. The unit ejection head 27 is a unit that includes the plurality of types of nozzles 21 capable of ejecting a plurality of colors of liquid. In this example, the unit ejection head 27 is a unit that includes four types of nozzles 21 capable of ejecting four colors of liquid.

As illustrated in FIG. 3, the plurality of unit ejection heads 27 are units in which one cap 41 covers the plurality of nozzles 21. That is, the plurality (N) of nozzles 21 included in the liquid ejection head 22 are covered by the plurality of (M) caps 41 for every plurality of unit ejection heads 27. In this example, the plurality of (N) nozzles 21 included in the liquid ejection head 22 are covered by twelve caps 41 every three unit ejection heads 27. As described above, the plurality of nozzles 21 included in the liquid ejection head 22 are divided and covered by the plurality of caps 41. The plurality of nozzles 21 covered by one cap 41 correspond to an example of a "nozzle group". The liquid ejection head 22 includes a plurality (M) of nozzle groups each including N/M nozzles 21. As described above, the liquid ejection head 22 includes the plurality (N) of nozzles 21 configured by the plurality (M) of nozzle groups. N and M are both natural numbers of 2 or more, and have a relationship of N>M.

When the nozzles 21 of the plurality of unit ejection heads 27 are projected in the transport direction of the medium M, the projected nozzles 21 of each unit ejection head 27 are arranged at regular intervals in the width direction of the medium M for each color of the liquid to be ejected. The detailed configuration of the liquid ejection head 22 will be described later.

The liquid ejection apparatus 11 includes a pressurization pump 29 that pressurizes and supplies the liquid stored in the liquid container 24 toward the head section 20. By driving the pressurization pump 29, the liquid is supplied from the liquid container 24 to the head section 20 through the supply flow path 25.

The maintenance section 40 includes the cap 41 and the discharge mechanism 44 described above which are disposed at positions facing the nozzle surface 28 of the liquid ejection head 22. The discharge mechanism 44 includes the waste liquid flow path 42 connecting the cap 41 and the waste liquid container 50, and the depressurization section 43 provided in the middle of the waste liquid flow path 42. The depressurization section 43 includes a buffer tank 52 that can store a fluid (mainly air) depressurized to a pressure lower than the atmospheric pressure, and a depressurization pump 43P that depressurizes the buffer tank 52. The waste liquid flow path 42 includes a plurality of branch flow paths 53 each having one end connected to each cap 41, a merge flow path 54 connecting the other end of each branch flow path 53 and the buffer tank 52, and two flow paths 55 connecting the buffer tank 52 and the waste liquid container 50.

Hereinafter, a detailed configuration of the maintenance section 40 will be described with reference to FIG. 3.

The cap 41 has a bottomed box shape that opens upward, and is relatively movable with respect to the nozzle surface 28 of the liquid ejection head 22. The cap 41 is moved from the retracted position in a direction approaching the liquid ejection head 22, a flushing position in which the cap 41 is separated from the nozzle surface 28 by a gap distance, and to a capping position in which a substantially closed space is formed by the nozzle surface 28 and the cap 41 by coming into contact with the nozzle surface 28. In this embodiment, the position of the cap 41 when the liquid ejection head 22 performs idle ejection is the flushing position. The capping position is the position where the cap 41 contacts the nozzle surface 28 when cleaning is performed or when printing is not performed. When the cap 41 is at the capping position, the nozzle 21 communicates with a substantially closed space formed by the cap 41 and the nozzle surface 28, and thus viscosity of the liquid in the nozzle 21 is suppressed.

As described above, one cap 41 is provided for every three unit ejection heads 27. One cap 41 is disposed at a position facing every three unit ejection heads 27. Every three unit ejection heads 27 are capped by one common cap 41. The idle ejection for ejecting liquid toward one common cap 41 is performed every three unit ejection heads 27. The liquid ejection head 22 is capped by the plurality of caps 41 at the time of standby during which printing is performed and when the power of the liquid ejection apparatus 11 is turned off. The number of unit ejection heads 27 capped by one common cap 41 is not limited to three, but may be two or four or more. However, when the number of unit ejection heads 27 is N, the number of unit ejection heads 27 commonly capped by one cap 41 may be N/3 or less.

The branch flow path 53 is provided with a first opening/closing valve 56 that permits or restricts flow of the fluid in the branch flow path 53. For that reason, if the first opening/closing valve 56 is opened when the cap 41 caps the liquid ejection head 22, the inside of the cap 41 and the buffer tank 52 are brought into a communication state via the branch flow path 53 and the merge flow path 54.

On the other hand, if the first opening/closing valve 56 is closed when the cap 41 caps the liquid ejection head 22, the inside of the cap 41 and the buffer tank 52 are brought into a non-communication state. Further, each first opening/closing valve 56 can be individually opened and closed. For that reason, by opening only the specific first opening/closing valve 56, only the inside of the specific cap 41 corresponding to the first opening/closing valve 56 and the buffer tank 52 can be brought into a communication state. The other end of each branch flow path 53 may be connected to the buffer tank 52 without providing the merge flow path 54.

The buffer tank 52 is provided with a pressure sensor 57 for measuring pressure of the buffer tank 52, and an atmosphere opening valve 58 for opening the buffer tank 52 to the atmosphere. The atmosphere opening valve 58 brings the buffer tank 52 and the atmosphere into a communication state when the valve is opened, and brings the buffer tank 52 and the atmosphere into a non-communication state when the valve is closed. For that reason, when the depressurization pump 43P is driven in a state where the first opening/closing valve 56 and the atmosphere opening valve 58 are closed, the buffer tank 52 is reduced to pressure (negative pressure) lower than the atmospheric pressure. In a state where the liquid ejection head 22 is capped and the buffer tank 52 is depressurized to the pressure lower than the atmospheric pressure, by opening any first opening/closing valve 56, negative pressure is quickly applied to any cap 41 communicating with the buffer tank 52. For that reason, the operation time for the suction cleaning and idle suction can be shortened.

As illustrated in FIG. 3, two depressurization pumps 43P are provided. The buffer tank 52 and the waste liquid container 50 are connected by two flow paths 55. The two depressurization pumps 43P are provided in the middle of the two flow paths 55, respectively, and depressurize the buffer tank 52 via the flow paths 55. As an example, by using one of the two depressurization pumps 43P as a diaphragm pump and the other as a rotary pump, the depressurization amount of one depressurization pump 43P is larger than the depressurization amount of the other depressurization pump 43P. The number of the depressurization pumps 43P may be one.

The maintenance section 40 further includes a wiping mechanism 60 that performs a wiping process on the nozzle surface 28 of the liquid ejection head 22 and a liquid discharge mechanism 61 that discharges ink removed by the wiping mechanism 60 to the waste liquid container 50.

The wiping mechanism 60 includes wiper member 62 and a wiper carriage 63 that supports the wiper member 62. The wiping mechanism 60 wipes the nozzle surface 28 with the wiper member 62 by moving the wiper carriage 63 in the direction along the X-axis.

The liquid discharge mechanism 61 includes a connection channel 64 connectable to the wiper carriage 63 and an opening/closing valve 65 provided in the middle of the connection channel 64. The downstream end of the connection channel 64 is connected to the buffer tank 52. When the opening/closing valve 65 is opened, the liquid removed by the wiper member 62 is discharged to the buffer tank 52.

Next, a detailed configuration of the liquid ejection head 22 will be described with reference to FIG. 4.

Figure 4:
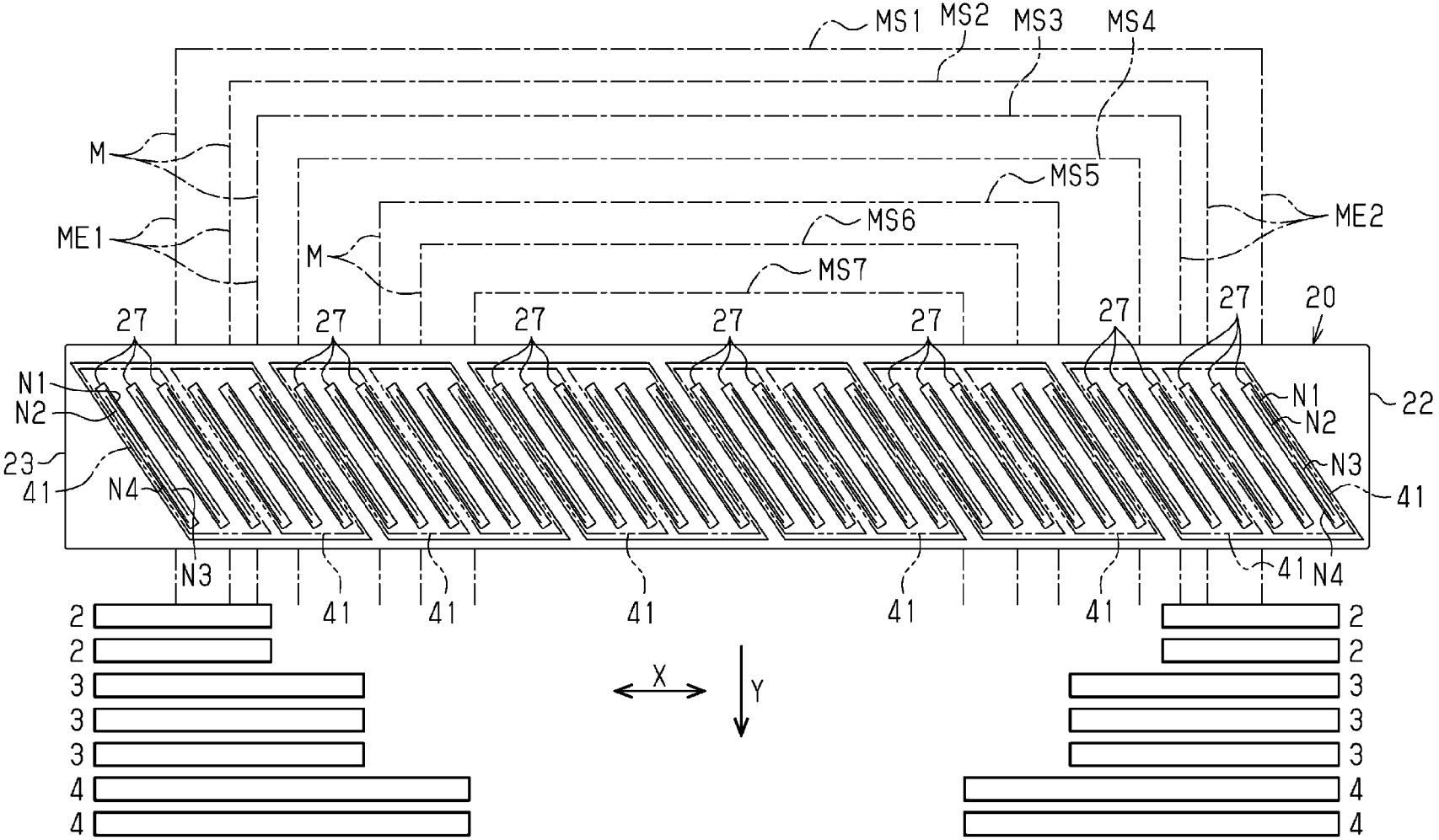
FIG. 4 is a schematic diagram illustrating a positional relationship between a bottom surface of a liquid ejection head and a cap, and second idle ejection.

As illustrated in FIG. 4, the liquid ejection head 22 includes a plurality of unit ejection heads 27. The plurality of unit ejection heads 27 are arranged at regular intervals in the width direction X at the bottom of the support portion 23. The unit ejection head 27 is configured by an elongated rectangular head chip. The plurality of unit ejection heads 27 are disposed obliquely at a predetermined angle with respect to the transport direction Y in which the medium M is transported.

As described above, one cap 41 indicated by a two-dot chain line in FIG. 4 faces the unit of three unit ejection heads 27. As illustrated in FIG. 4, the cap 41 has a parallelogram opening shape in a plan view (that is, a bottom view), and has a shape capable of capping three unit ejection heads 27 disposed obliquely with respect to the transport direction Y at a time.

In FIG. 4, the medium M transported in the transport direction Y intersecting the width direction X, which is the longitudinal direction of the liquid ejection head 22, is indicated by one-dot chain line. In FIG. 4, a plurality of types of media M having different sizes, which are the sizes of the media M on which the liquid ejection apparatus 11 can print, are illustrated. In FIG. 4, seven types of medium sizes MS1 to MS7 are illustrated in order from the larger size to the smaller size of the medium M.

Figure 5:
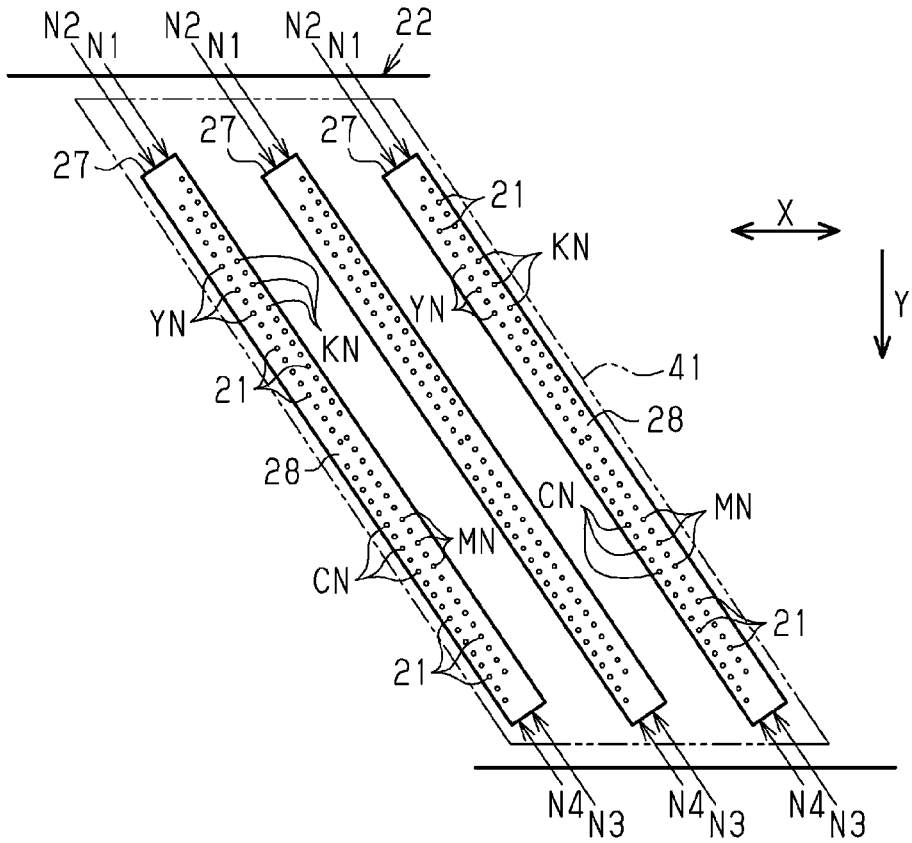
FIG. 5 is a partial bottom view illustrating the bottom surface of the liquid ejection head.

In FIG. 5, three unit ejection heads 27, which are units capped by one cap 41 are illustrated. The unit ejection head 27 has four nozzle rows N1 to N4 in which a plurality of nozzles 21 opening on the nozzle surface 28 are arranged in a row. Each of the nozzle rows N1 to N4 has a predetermined number of nozzles 21 arranged in a row along the longitudinal direction of the unit ejection head 27. In FIG. 5, although the number of nozzles 21 is simplified, in practice, the nozzles 21 form one nozzle row with a predetermined number (for example, 400) in the range of 200 to 1000 nozzles.

The liquid ejection apparatus 11 of this embodiment can perform color printing, and the nozzles 21 includes a first nozzle KN for ejecting black ink, a second nozzle YN for ejecting yellow ink, a third nozzle MN for ejecting magenta ink, and a fourth nozzle CN for ejecting cyan ink. The first nozzle row N1 includes a plurality of first nozzles KN arranged in a row at a constant nozzle pitch. The second nozzle row N2 includes a plurality of second nozzles YN arranged in a row at a constant nozzle pitch. The third nozzle row N3 includes a plurality of third nozzles MN arranged in a row at a constant nozzle pitch. The fourth nozzle row N4 includes a plurality of fourth nozzles CN arranged in a row at a constant nozzle pitch.

The positions of the nozzles KN, YN, MN, and CN projected in the transport direction are arranged at equal intervals for each color in the entire width direction of the medium M having the maximum width. That is, the equally spaced distance is the dot pitch when printing on the medium M. As described above, in the liquid ejection head 22 of this embodiment, an inclination angle at which the unit ejection heads 27 are disposed is set so that projected nozzles are arranged in the width direction at a nozzle pitch corresponding to required dot resolution when the nozzles 21 are projected in the transport direction.

Figure 6:
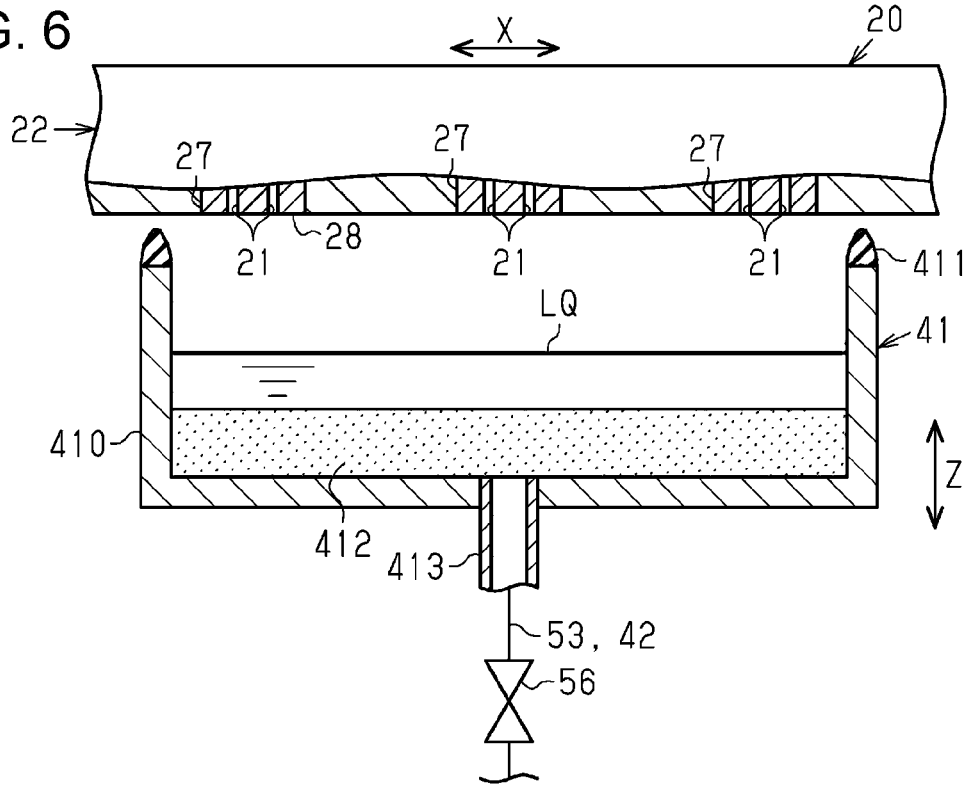
FIG. 6 is a schematic cross-sectional view illustrating a structure of the cap.

As illustrated in FIG. 6, the cap 41 is disposed at a position corresponding to three unit ejection heads 27 during idle ejection. When the cap 41 is at the flushing position, as illustrated in FIG. 6, an elastic piece provided at the upper end of the cap 41 is positioned at a position separated downward from the nozzle surface by a predetermined distance. The cap 41 includes a parallelogram box-shaped cap body 410 having an open upper part, and an annular seal portion 411 made of an elastic member such as an elastomer attached to the upper end of the cap body 410. The seal portion 411 has a parallelogram annular shape. At the inner bottom of the cap body 410, a porous liquid absorbing material 412 is disposed. A discharge pipe 413 communicating with the inside of the cap 41 protrudes from the bottom of the cap body 410. A tube (not illustrated) is externally inserted into the discharge pipe 413. The tube forms the branch flow path 53.

In this embodiment, the liquid includes a functional component, a solvent that dissolves the functional component or a dispersion medium that disperses the functional component, and a moisturizing component. When the liquid is water-based ink, the liquid contains a dye or pigment as a color component, water used for dissolving the dye or dispersing the pigment, and a moisturizing component. In this embodiment, the liquid ejected from the nozzles 21 by the liquid ejection head 22 is, for example, a water-based ink, and includes a moisturizing component as an ink component. The moisturizing component has a property of absorbing water. For that reason, ink containing a moisturizing component is less likely to evaporate water. Therefore, viscosity of the ink in the nozzle 21 does not easily increase.

No liquid is ejected from non-ejection nozzles, which are nozzles 21 not used for printing during printing. The ejection of the liquid from the nozzle 21 has a function of replacing the liquid in the nozzle 21 to refresh the liquid. For that reason, the liquid in the nozzle 21 is replaced for the nozzle 21 used for printing and refreshed each time, but the liquid in the nozzle is not replaced for the non-ejection nozzle. During printing, the liquid in the non-ejection nozzle gradually increases in viscosity with the passage of time, so during printing, every time a predetermined time elapses from the previous last idle discharge execution time, idle ejection for ejecting liquid unrelated to printing from the nozzle 21 is performed. The idle ejection is performed at a flushing position where the cap 41 is separated from the nozzle surface 28 in order to prevent droplets produced through bouncing of liquid from adhering to the nozzle surface 28.

As illustrated in FIG. 6, liquid LQ accumulates in the cap 41 by performing idle ejection periodically during printing. When the liquid LQ in the cap 41 reaches a predetermined liquid amount, the liquid LQ accumulated in the cap 41 is suctioned, and idle suction for sucking the liquid LQ accumulated in the cap 41 and discharging the liquid LQ to the waste liquid container 50 through the waste liquid flow path 42 is performed.

The liquid discharged from the non-ejection nozzle to the cap 41 illustrated in FIG. 6 by the idle ejection contains a large amount of liquid increased in viscosity. The liquid increased in viscosity has a higher ratio of the moisturizing component to water than the liquid of which viscosity is not increased. The moisturizing component has a property of absorbing moisture. When comparing the liquid in the nozzle 21 with the liquid increased in viscosity in the cap 41, the liquid increased in viscosity has a higher ratio of the moisturizing component to water. For that reason, in the cap 41 during capping, the liquid increased in viscosity in the cap 41 absorbs moisture from the liquid in the nozzle 21 so that the liquid in the nozzle 21 and the liquid increased in viscosity in the cap 41 have the same moisture ratio. Specifically, since the liquid increased in viscosity in the cap 41 absorbs moisture in the air in the cap 41, the moisture in the air is reduced in the cap 41, and the moisture in the liquid in the nozzle 21 is easily evaporated. The moisture transfer phenomenon occurring in the cap 41 proceeds continuously between the liquid increased in viscosity and the liquid in the nozzle 21 until the ratio of moisture to the moisturizing component becomes the same. As a result, when a non-ejection nozzle is included, an increase in viscosity of the liquid in the nozzle 21 proceeds even though the unit ejection head 27 is capped by the cap 41.

As illustrated in FIG. 4, when printing on the medium M, the liquid is not ejected to the outside of the medium M in the width direction X, and thus the liquid in the nozzles 21 positioned outside is more likely to increase in viscosity than the nozzles 21 positioned inside in the width direction X of the medium.

Then, among the plurality of caps 41 in FIG. 4, the ratio of the liquid increased in viscosity in the accumulated liquid is higher in the outer cap 41 that contains the liquid ejected from the outer nozzle 21 in the width direction X of the medium M than in the inner cap 41 that contains the liquid ejected from the inner nozzle 21 in the width direction X of the medium M. For that reason, in the cap 41 having a high ratio of the liquid increased in viscosity, the liquid in the nozzle 21 is deprived of moisture during standby, and thus viscosity in the liquid tends to increase. In this embodiment, the ratio of the liquid increased in viscosity in the liquid in the cap 41 is reduced, and the increase in viscosity of liquid in the nozzle 21 in the cap 41 during standby is suppressed.

In the cap 41 that contains the liquid ejected from the nozzle 21 positioned outside the width direction of the medium M, the ratio of the liquid increased in viscosity in the waste liquid is high. For that reason, in this embodiment, at the timing of idle suction for discharging the waste liquid accumulated in the cap 41, after the idle suction, the idle ejection for ejecting the fresh liquid into the cap 41 positioned at the end portion where the ratio of the liquid increased in viscosity is considered to be high is performed. In this embodiment, this idle ejection is distinguished from first idle ejection (normal flushing) in which droplets are periodically ejected from all the nozzles 21, and is also referred to as second idle ejection (end portion flushing).

Figure 9:
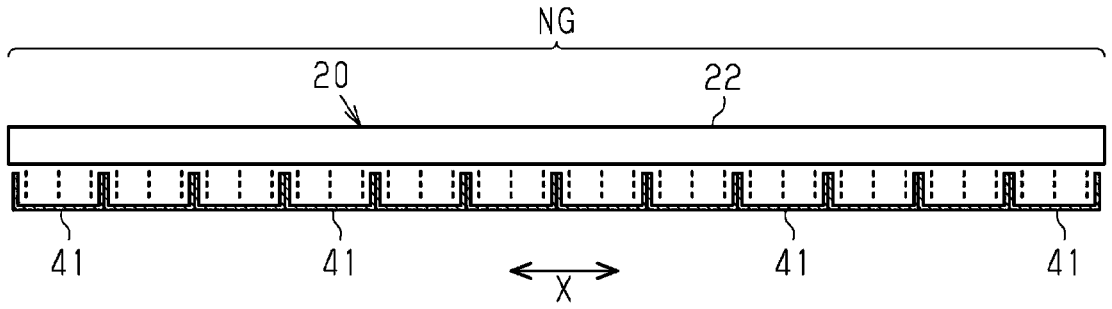
FIG. 9 is a schematic diagram illustrating first idle ejection in which liquid is ejected from all nozzles.

Specifically, when printing based on a printing job is completed, the transport belt 34 is moved from the support position to the retracted position by the support portion moving mechanism 37, and the cap 41 is moved from the retracted position to the flushing position by the cap moving mechanism 45. The liquid ejection head 22 performs the first idle ejection for ejecting the liquid from all the nozzles 21 (see FIG. 9). After the first idle ejection, the first opening/closing valve 56 is switched from a valve closing state to a valve opening state, and the idle suction of the cap 41 is performed. The idle suction is performed sequentially for each unit, with the plurality of caps 41 as one unit. After the idle suction, the second idle ejection in which the liquid is ejected from the nozzles 21 belonging to the nozzle group including the nozzles 21 that were non-ejection nozzles positioned outside the width direction X of the medium M in the immediately preceding printing toward the cap 41 at the facing end portion is performed. At the time of the second idle ejection, the ink increased in viscosity in the cap 41 has been discharged. However, even after the idle suction, a small amount of the ink increased in viscosity remains in the liquid absorbing material 412. By performing the second idle ejection, a small amount of the ink increased in viscosity remaining in the liquid absorbing material 412 is diluted. Since the second idle ejection is performed by ejecting liquid from the nozzle 21 after ink increased in viscosity in the nozzle 21 is discharged by the first idle discharge performed before the idle suction, fresh ink can be ejected into the cap 41 at the end.

Figure 8:
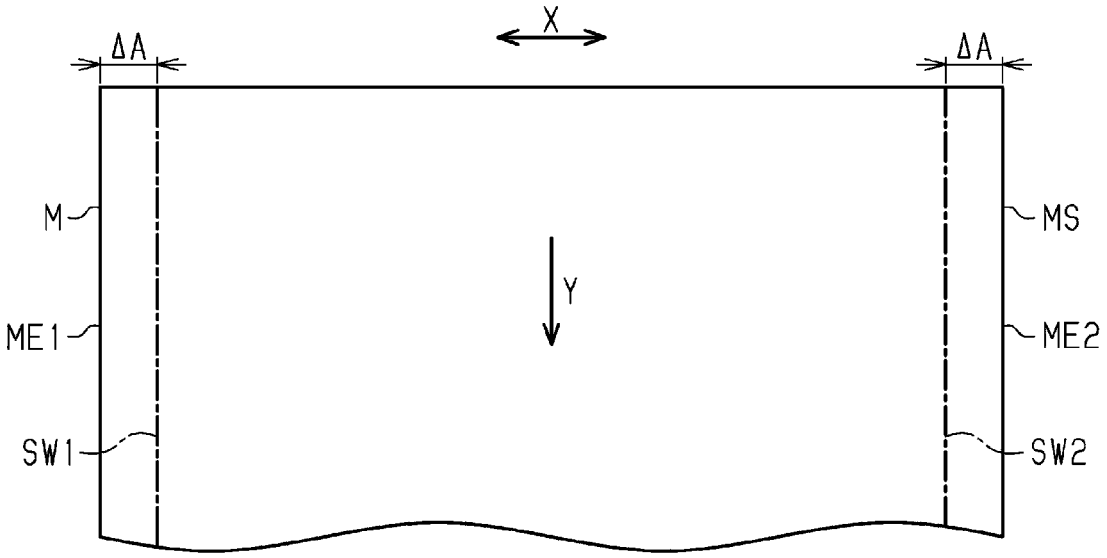
FIG. 8 is a schematic diagram illustrating a medium and a setting position.

As illustrated in FIG. 8, the nozzles 21 that performs the second idle ejection is determined according to the size of the medium M. The nozzles 21 positioned in an area outside the side ends ME1 and ME2 in the width direction of the medium M is a non-ejection nozzle. The nozzle groups including non-ejection nozzles positioned in the area outside the side edges ME1 and ME2 in the width direction of the medium M may be set as nozzle groups that can easily eject the ink increased in viscosity, and all the nozzles that eject the liquid from these nozzle groups to the cap 41 that contains the liquid ejected during the first idle ejection may be determined as the nozzles 21 that perform the second idle ejection. However, there are relatively many printings having margins at both ends in the width direction of the medium M. For that reason, in this embodiment, the nozzle 21 that performs the second idle ejection is determined according to the size of the medium M in consideration of the size of the margins at both ends in the width direction.

That is, as illustrated in FIG. 8, setting positions SW1 and SW2 are set at positions inside by a predetermined set distance ΔA in the width direction X from side ends ME1 and ME2 on both sides in the width direction X of the medium M. All nozzles 21 that eject liquid from the nozzles 21 positioned outside the setting positions SW1 and SW2 to the cap 41 that contains the liquid increased in viscosity ejected during the first idle ejection are determined as the nozzles 21 that perform the second idle ejection. The set distance ΔA may be a constant value common to different medium sizes, or may be a different value according to the medium size.

Figure 7:
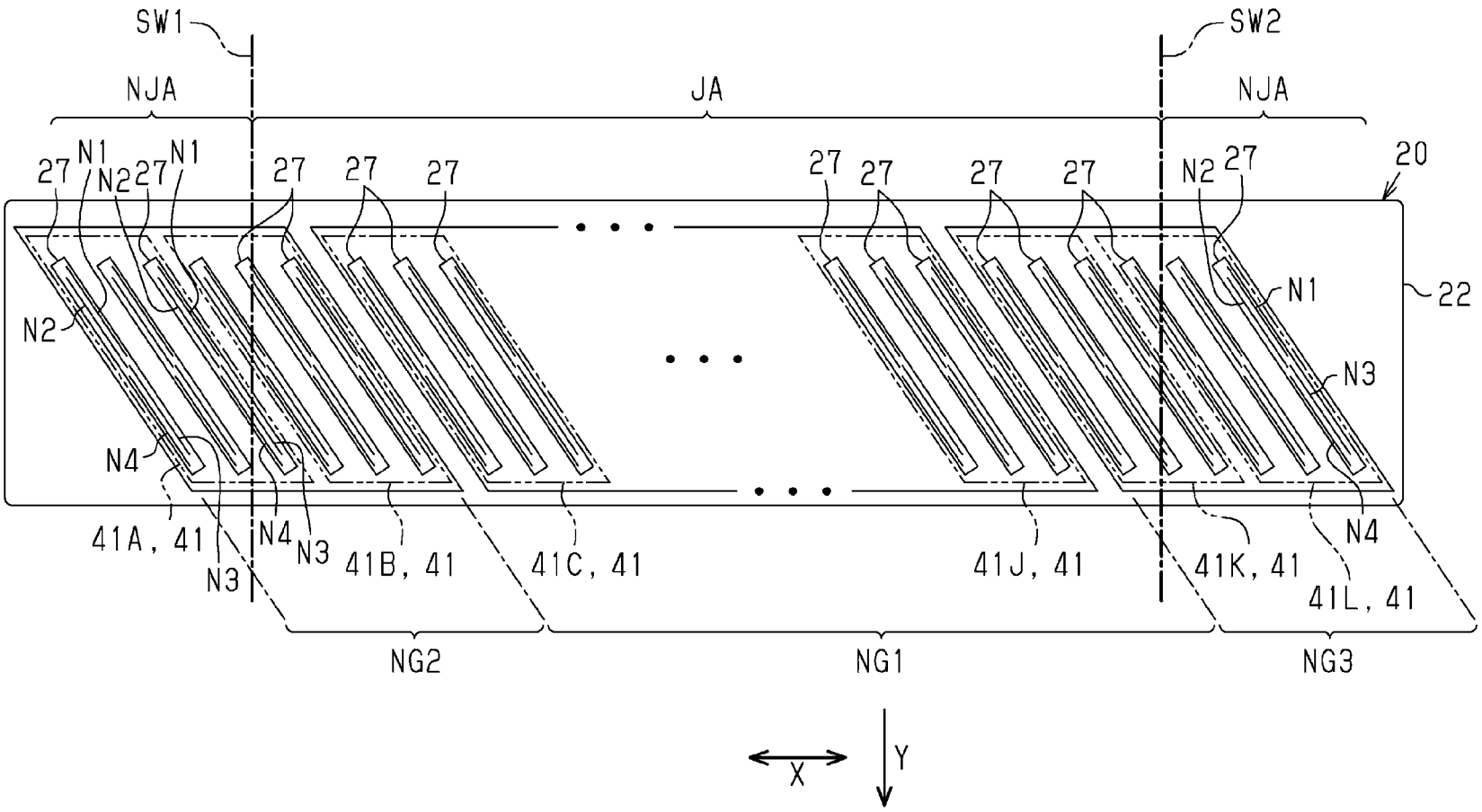
FIG. 7 is a partial bottom view illustrating the liquid ejection head for describing the second idle ejection.

As illustrated in FIG. 7, when the setting positions SW1 and SW2 according to the size of the medium M are set in the medium M, an area outside the setting positions SW1 and SW2 in the width direction of the medium M is a non-ejection area NJA to which a non-ejection nozzle, which is the nozzle 21 that does not eject liquid during printing, belongs. An area inside the setting positions SW1 and SW2 including the setting positions SW1 and SW2 is an ejection area JA to which the ejection nozzle, which is the nozzle 21 that ejects liquid during printing, belongs. The nozzle 21 positioned in the non-ejection area NJA is regarded as a non-ejection nozzle, and the cap 41 that contains the liquid increased in viscosity ejected from the non-ejection nozzle during the first idle ejection is determined. The group of nozzles 21 that ejects the liquid to the determined cap 41 is the nozzle group that is to perform the second idle ejection.

Among the caps 41 that receive liquid from the nozzles 21 positioned in the ejection area JA, a group of nozzles 21 that can eject liquid toward the cap 41 that contains liquid ejected only from the nozzles 21 positioned in the ejection area JA is referred to as a first nozzle group NG1. All nozzle groups of the liquid ejection head 22 are divided into the first nozzle group NG1 and two remaining nozzle groups NG2 and NG3 positioned on both sides sandwiching the first nozzle group NG1 in the width direction X. Of the two nozzle groups NG2 and NG3 positioned on both sides sandwiching the first nozzle group NG1 in the width direction X, the nozzle group positioned at one end of the liquid ejection head 22 in the width direction X is referred to as a second nozzle group NG2, and the nozzle group positioned at the other end is referred to a third nozzle group NG3. The nozzle group positioned at the other end is referred to as a third nozzle group NG3.

The second nozzle group NG2 includes one or more non-ejection nozzles positioned in an area outside the first setting position SW1 in the immediately preceding printing. The third nozzle group NG3 includes one or more non-ejection nozzles positioned in an area outside the second setting position SW2 in the immediately preceding printing. The second nozzle group NG2 and the third nozzle group NG3 are determined as the nozzles 21 that perform the second idle ejection.

The liquid ejection head 22 is configured to execute first idle ejection in which liquid is ejected from the plurality of nozzles 21 constituting a plurality of nozzle groups to a plurality of caps 41 and second idle ejection in which liquid is ejected from the plurality of nozzles 21 constituting the second nozzle group NG2 and the third nozzle group NG3 to the second cap group and the third cap group. Here, the second cap group refers to a group of caps 41 that contains the liquid ejected in the second idle ejection from the plurality of nozzles 21 constituting the second nozzle group NG2. The second cap group is not limited to including a plurality of caps 41, and may include only one cap 41. The third cap group refers to a group of caps 41 that receive the liquid ejected in the second idle ejection from the plurality of nozzles 21 constituting the third nozzle group NG3. The third cap group is not limited to including a plurality of caps 41, but may include only one cap 41.

In the example illustrated in FIG. 7, the plurality of caps 41 includes twelve caps 41A to 41L. Eight caps 41C to 41J that receive the liquid ejected from the nozzles 21 constituting the first nozzle group NG1 constitute a first cap group. The two caps 41A and 41B that receive the liquid ejected from the nozzles 21 constituting the second nozzle group NG2 constitute a second cap group. Furthermore, the two caps 41K and 41L that receive the liquid discharged from the nozzles 21 constituting the third nozzle group NG3 constitute a third cap group.

As illustrated in FIG. 4, the positions of the side edges ME1 and ME2 in the width direction X of the medium M differ depending on the medium sizes MS1 to MS7 of the medium M. For that reason, the second nozzle group NG2 and the third nozzle group NG3 are determined according to the medium sizes MS1 to MS7.

In FIG. 4, below the liquid ejection head 22, the areas of the second nozzle group NG2 and the third nozzle group NG3 are indicated by white rectangles. Each area of the second nozzle group NG2 and the third nozzle group NG3 is indicated by the positions and the numbers of the caps 41 that receive the liquid ejected from the second nozzle group NG2 and the third nozzle group NG3. The numbers illustrated beside the white rectangle in FIG. 4 indicate the numbers of caps 41 that are moisturized by ejecting the liquid in the second idle ejection. That is, the numbers of caps 41 constituting the second cap group are illustrated on the left side in FIG. 4, and the numbers of caps 41 constituting the third cap group are illustrated on the right side in FIG. 4.

As the medium size becomes smaller, the number of caps 41 that eject liquid by the second idle ejection and are moisturized increases. That is, as the medium size becomes smaller, the amount of liquid consumed for uses other than printing increases. In the sense of diluting a small amount of the liquid increased in viscosity remaining after idle suction in the cap 41, the amount of liquid ejected from one nozzle 21 during the second idle ejection is larger than the amount of liquid ejected from one nozzle 21 during the first idle ejection. When the amount of liquid consumed by the second idle ejection increases, the yield indicating the number of sheets of printings that can be printed with the liquid amount of one liquid container 24 fully filled with liquid deteriorates. For that reason, the amount of liquid ejected in the second idle ejection may be the same as the amount of liquid ejected in the first idle ejection. A configuration in which the amount of the liquid ejected in the second idle ejection can be selected by the user, for example, by considering the yield and the discharge failure may be adopted.

In this embodiment, the first idle ejection is performed every predetermined time in a period during which printing is performed. When the flushing time comes, the first idle ejection is performed during printing. If there is no next printing job at the end of printing, the first idle ejection is also performed at the end of printing. The control section 100 manages the amount of liquid accumulated in the cap 41. When the amount of liquid accumulated in the cap 41 becomes equal to or larger than a predetermined threshold value, the control section 100 drives the discharge mechanism 44 to perform idle suction for discharging the liquid accumulated in the cap 41 by suction. As described above, in this embodiment, the second idle ejection is executed after the liquid is discharged the plurality of caps 41 by the discharge mechanism 44. That is, the second idle ejection is executed after the idle suction performed when a predetermined amount of liquid is accumulated in the cap 41 by a plurality of times of first idle ejection. For that reason, in this embodiment, the cycle at which the second idle ejection is performing is set to be longer than the cycle at which the first idle ejection is performed.

The liquid ejection head 22 is configured to eject black ink as liquid and color ink different from the black ink. A user who performs monochrome printing in which only black ink is ejected by the liquid ejection head 22 has uncomfortable feeling when color ink is consumed due to the second idle ejection. For that reason, the amount of black ink ejected from one nozzle 21 during the second idle ejection may be larger than the amount of color ink ejected from one nozzle 21 during the second idle ejection.

As illustrated in FIG. 1, the liquid ejection apparatus 11 includes a plurality of medium storing portions 16 that store the medium M. In this embodiment, the control section 100 determines a plurality of nozzles 21 constituting the second nozzle group NG2 and the third nozzle group NG3 according to the width of the medium M stored in the medium storing portion 16.

The user cannot specify which medium M of which medium storing portion 16 of the plurality of medium storing portions 16 is designated to be subjected to printing until printing data is received. For that reason, when it is desired to reduce processing load on the control section 100 when receiving printing data, the second nozzle group NG2 and the third nozzle group NG3 for performing the second idle ejection may be determined in advance according to the medium size detected by each size sensor 19.

As one of the methods, the control section 100 may determine the plurality of nozzles 21 constituting the second nozzle group NG2 and the third nozzle group NG3 according to the width of the type of medium having the largest width among the plurality of types of media M stored in the plurality of medium storing portions 16.

As another method, the control section 100 may determine the plurality of nozzles 21 constituting the second nozzle group NG2 and the third nozzle group NG3 according to the width of the type of medium having the smallest width among the plurality of types of media M stored in the plurality of medium storing portions 16.

Furthermore, as illustrated in FIG. 2, a detecting portion 38 that detects the width of the medium M to be transported, which is indicated by a two-dot chain line in FIG. 2, may be further provided. When a predetermined number of sheets of media M are transported, the control section 100 determines a plurality of nozzles 21 constituting the second nozzle group NG2 and the third nozzle group NG3 according to the width of a type of the media of which the number of sheets is largest among the predetermined number of sheets of the media.

Next, an electrical configuration of the liquid ejection apparatus 11 will be described with reference to FIG. 11.

Figure 11:
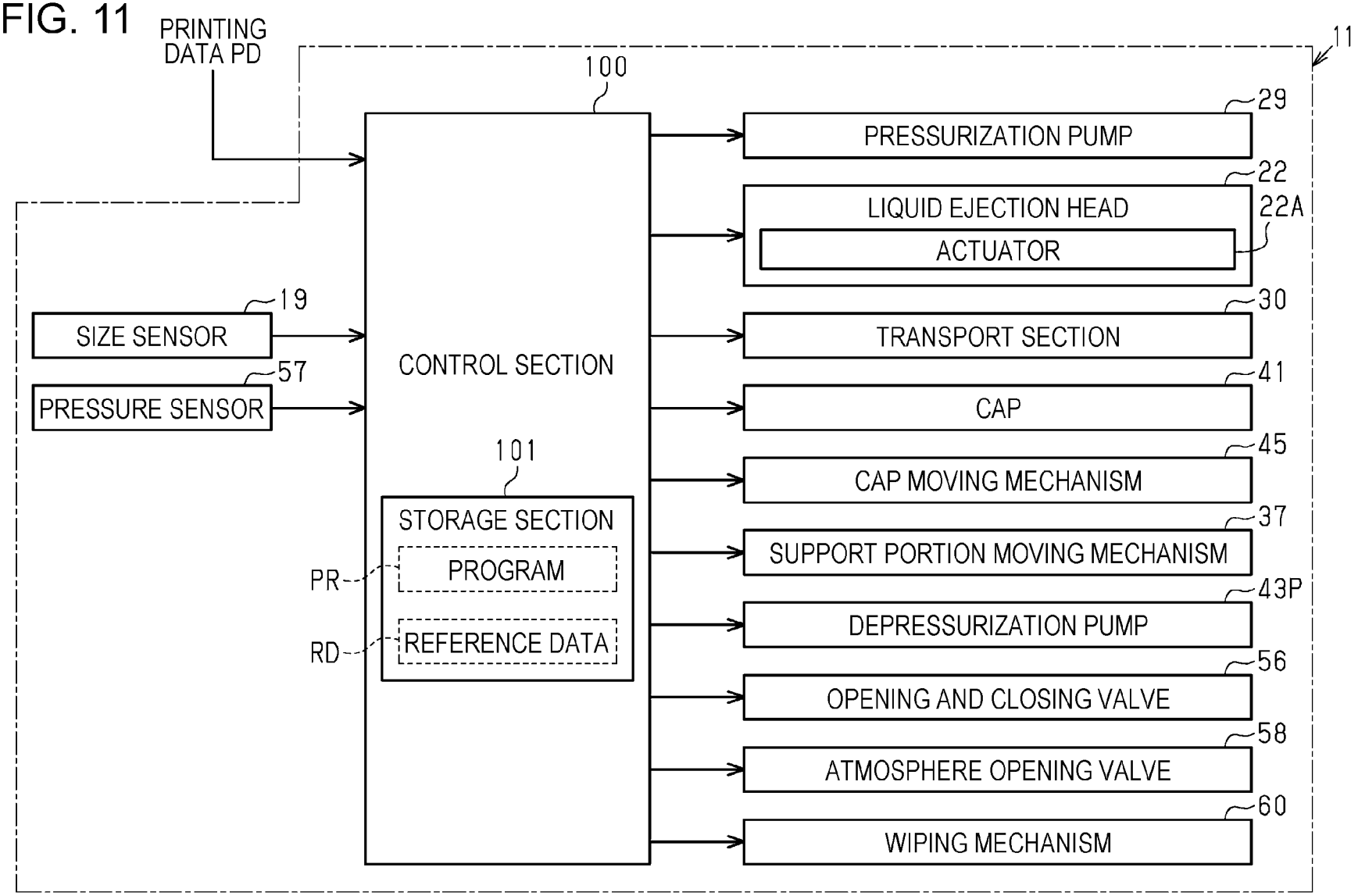
FIG. 11 is a block diagram illustrating an electrical configuration of the liquid ejection apparatus.

As illustrated in FIG. 11, the size sensor 19 and the pressure sensor 57 are connected to an input side interface (not illustrated) of the control section 100. On the other hand, the pressurization pump 29, the liquid ejection head 22, an actuator 22A, the transport section 30, the cap 41, the cap moving mechanism 45, the support portion moving mechanism 37, the depressurization pump 43P, the first opening/closing valve 56, the atmosphere opening valve 58, and the wiping mechanism 60 are connected to an output side interface of the control section 100.

The control section 100 operates the cap moving mechanism 45 to cap the nozzle surface 28 of the liquid ejection head 22 with the cap 41 or to eliminate the capping.

The control section 100 performs cleaning for eliminating the ejection failure in the liquid ejection head 22 by operating the configurations connected to the output side interface, based on output signals from the actuator 22A and the pressure sensor 57. The control section 100 detects a defective nozzle based on, for example, an output signal from the actuator 22A that has detected residual vibration of a diaphragm immediately after an ejection operation. When the defective nozzle is detected, the control section 100 may individually perform cleaning on the nozzle group including the defective nozzle in units of the cap 41.

The control section 100 performs the wiping process on the nozzle surface 28 of the liquid ejection head 22 by operating the wiper carriage 63 and the opening/closing valve 65 based on the output signals from the liquid ejection head 22 and the cap moving mechanism 45.

Figure 13:
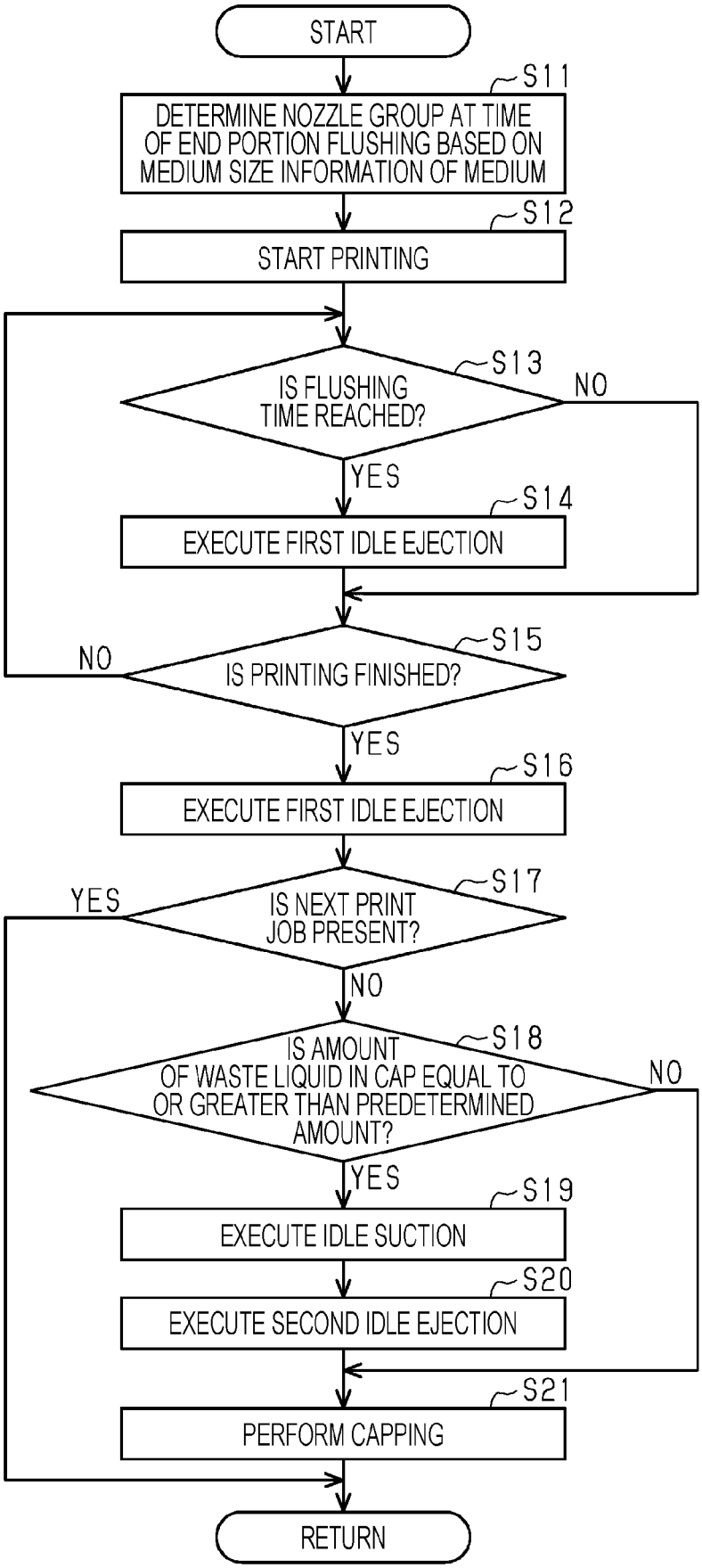
FIG. 13 is a flowchart illustrating a printing control process.

The control section 100 includes a storage section 101. The storage section 101 stores a program PR relating to the printing control process illustrated in the flowchart in FIG. 13. The control section 100 executes the printing control process by executing the program PR.

The storage section 101 stores reference data RD illustrated in FIG. 12. The reference data RD is data indicating the correspondence between the medium size and the first to third nozzle groups NG1 to NG3. The row of the first nozzle group NG1 indicates the number of unit nozzle groups belonging to the first nozzle group NG1. The unit nozzle group is a group of nozzles 21 that can eject liquid to one cap 41. The row of the second nozzle group NG2 indicates the number of unit nozzle groups belonging to the second nozzle group NG2. The row of the third nozzle group NG3 indicates the number of unit nozzle groups belonging to the third nozzle group NG3. In the reference data RD, the number of unit nozzle groups obtained based on the setting positions SW1 and SW2 for each of the medium sizes MS1 to MS8 is set. The number of unit nozzle groups set in the second nozzle group NG2 and the third nozzle group NG3 is equal to the number of caps 41 that contain liquid from the nozzles 21 where the second idle ejection is performed. Data of the first nozzle group NG1 may be deleted from the reference data RD. If the number of unit nozzle groups is the same between the second nozzle group NG2 and the third nozzle group NG3, data of only one of the second and nozzle groups NG2 and NG3 may be used. A calculation formula may be stored instead of the reference data RD, and the control section 100 may calculate and determine the nozzle 21 for performing the second idle ejection.

Next, an operation of the liquid ejection apparatus 11 of this embodiment will be described.

Hereinafter, the printing control process executed by the control section 100 will be described. When printing data PD is received, the control section 100 executes the printing control process. The printing data PD includes printing condition information including information on a medium size, a medium type, a printing color, and the like. In the case of the liquid ejection apparatus 11 including a plurality of medium storing portions 16, the printing condition information may include a tray number.

First, in step S11, the control section 100 determines a nozzle group at the time of the second idle ejection based on information of the medium size included in the printing condition information in the printing data PD. Specifically, the control section 100 acquires the tray number indicating a storage destination of the medium M to be printed from the printing condition information. The control section 100 acquires the medium size of the medium M stored in the medium storing portion 16 corresponding to the tray number. The control section 100 acquires the medium size detected by the size sensor 19 corresponding to the tray number, which is one of the medium size information. The control section 100 determines the second nozzle group NG2 and the third nozzle group NG3 to be subjected to the second idle ejection with reference to the reference data RD stored in the storage section 101 based on the acquired medium size. In the example illustrated in FIG. 12, the second nozzle group NG2 and the third nozzle group NG3 are acquired as the number of unit nozzle groups belonging to each of the second and third nozzle groups NG2 and NG3. The control section 100 temporarily stores information on the second nozzle group NG2 and the third nozzle group NG3 to be subjected to the second idle ejection in a predetermined storage area of the storage section 101. If the second nozzle group NG2 and the third nozzle group NG3 are determined, the first nozzle group NG1 existing in an area between the two is uniquely determined.

In step S12, the control section 100 starts printing. The medium M is fed one by one from the medium storing portion 16. The fed medium M is transported by the transport belt 34 in the transport direction Y. The liquid ejection head 22 ejects liquid from the nozzle 21 toward the medium M. The printed medium M is transported downstream along the transport path by the rollers 33, is discharged, and is stacked on the placement surface 17A of the placement portion 17. In this way, the liquid is ejected from the nozzles 21 of the liquid ejection head 22 toward the medium M sequentially fed from the medium storing portion 16 and transported by the transport belt 34, so that printing is sequentially performed on the medium M.

In step S13, the control section 100 determines whether or not the flushing time is reached. When it is determined that the flushing time is reached, the process proceeds to step S14, and when it is determined that the flushing time is not reached, the process proceeds to step S15.

In step S14, the control section 100 executes the first idle ejection. Specifically, the control section 100 drives the support portion moving mechanism 37 to move the transport belt 34 from the support position to the retracted position, and drives the cap moving mechanism 45 to move the cap 41 from the retracted position to the flushing position. Then, the control section 100 controls the liquid ejection head 22 to eject liquid from all the nozzles 21 toward the plurality of caps 41 (see FIG. 9). When the first idle ejection is completed, the control section 100 drives the cap moving mechanism 45 to move the cap 41 from the flushing position to the retracted position, and drives the support portion moving mechanism 37 to move the transport belt 34 from the retracted position to the support position. The control section 100 resumes printing on the next medium M in the printing job being executed.

In step S15, the control section 100 determines whether or not the printing is completed. When it is determined that the printing is not completed, the control section 100 returns to step S13, continues printing, and repeatedly executes the processes of steps S13 to S15. When printing based on one printing job is completed, the printing control process proceeds to step S16.

In step S16, the control section 100 executes the first idle ejection. First, the control section 100 drives the support portion moving mechanism 37 to move the transport belt 34 from the support position to the retracted position, and also drives the cap moving mechanism 45 to move the cap 41 from the retracted position to the flushing position. The control section 100 performs the first idle ejection in which the liquid is ejected from the plurality of nozzles 21 constituting the plurality of nozzle groups included in the liquid ejection head 22 to the plurality of caps 41. That is, the control section 100 performs the first idle ejection in which the liquid is ejected from all the nozzles 21 of the liquid ejection head 22 (see FIG. 9).

In step S17, the control section 100 determines whether or not there is a next printing job. When it is determined that a next printing job is present, the printing control process ends. This is because the current print process is completed early and the process of the next printing job is started early. On the other hand, when it is determined that the next printing job is not present, the printing control process proceeds to the process in step S18.

In step S18, the control section 100 determines whether or not the amount of waste liquid in cap 41 is equal to or greater than a predetermined amount. The control section 100 acquires the amount of waste liquid in the cap 41 from the time when the previous idle suction is completed by counting the amount of liquid ejected by the nozzle 21 by the first idle ejection using a counter (not illustrated). When it is determined that the amount of waste liquid in the cap 41 is not equal to or greater than the predetermined amount, the printing control process proceeds to step S21, and the nozzle surface 28 is capped by the cap 41, and the printing control process ends. At this time, the cap 41 may be raised, the head section 20 may be lowered, or both the cap 41 and the head section 20 may be raised and lowered. On the other hand, when it is determined that the waste liquid in the cap 41 is equal to or greater than the predetermined amount, the printing control process proceeds to step S19.

In step S19, the control section 100 executes the idle suction. The control section 100 opens the first opening/closing valve 56 which is in a valve-closed state. As a result, the waste liquid in the cap 41 is suctioned and discharged through the waste liquid flow path 42 due to the negative pressure from the buffer tank 52 depressurized by the depressurization pump 43P. The waste liquid sucked and discharged is sent to the buffer tank 52 through the waste liquid flow path 42, and further discharged from the buffer tank 52 to the waste liquid container 50 by driving the depressurization pump 43P. After finishing the idle suction, the control section 100 proceeds to step S20.

Figure 10:
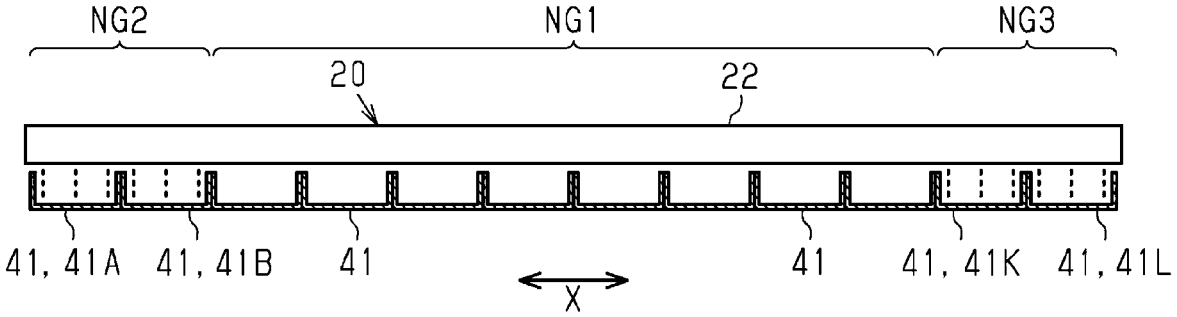
FIG. 10 is a schematic view illustrating the second idle ejection in which liquid is ejected from nozzles at end portions.

In step S20, the control section 100 executes the second idle ejection. The control section 100 reads information of the second nozzle group NG2 and the third nozzle group NG3 determined in step S11 from a predetermined storage area of the storage section 101. The control section 100 performs the second idle ejection by ejecting the liquid from the plurality of nozzles 21 constituting the second nozzle group NG2 and the third nozzle group NG3 included in the liquid ejection head 22 to the second cap group and the third cap group (see FIG. 10).

The second idle ejection is performed after the waste liquid in the cap 41 is discharged by the idle suction. After the idle suction, even if a little waste liquid containing the liquid increased in viscosity remains in the cap 41 in a form absorbed by the liquid absorbing material 412, the moisturizing component contained in the liquid increased in viscosity in the slightly remaining waste liquid is sufficiently diluted by the liquid supplied by the second idle ejection. By performing the first idle ejection between the end of the current printing and the idle suction, the liquid increased in viscosity is discharged from all the nozzles 21 and replaced with fresh liquid. For that reason, fresh liquid is ejected to the plurality of caps 41 constituting the second and third cap groups by the second idle ejection.

When the control section 100 performs control to make the amount of liquid ejected from one nozzle 21 during the second idle ejection larger than the amount of liquid ejected from one nozzle 21 during the first idle ejection, more fresh liquid is supplied into the end cap 41, and the liquid increased in viscosity remaining in the cap 41 is sufficiently diluted. Therefore, thereafter, the nozzle at the time of capping can be moisturized by the waste liquid in the cap 41 for a long time.

When the control section 100 performs control to make the amount of black ink ejected from one nozzle 21 during the second idle ejection larger than the amount of color ink ejected from one nozzle 21 during the second idle ejection, the consumption of color ink can be suppressed to be small. For example, a user who frequently uses monochrome printing may feel uncomfortable when color ink is consumed even though color printing is not performed, but such a situation can be avoided.

Further, only when the remaining amount of the color ink is lower than the predetermined threshold, control may be performed such that the corresponding color ink is not used for the second idle ejection. In this case, it is possible to avoid that the remaining amount of the color ink is further reduced by the second idle ejection and the number of printable sheets that can be printed in color is reduced.

The second idle ejection is performed in the same cycle as the idle suction. Therefore, the second idle ejection is performed in a cycle longer than the cycle in which the first idle ejection is performed. For that reason, the consumption of the liquid can be suppressed to be small.

Furthermore, the control section 100 may determine the plurality of nozzles 21 constituting the second nozzle group NG2 and the third nozzle group NG3 according to the width of a type of the medium having a largest width among the plurality of types of media M stored in the plurality of medium storing portions 16. In this case, the second idle ejection can be performed by predicting a nozzle group in which both ends may be missing. For example, when the printing data PD is received, the process of determining the nozzle group to be used for the second idle ejection is not required, and the control section 100 can start printing quickly. Since the second nozzle group NG2 and the third nozzle group NG3 are determined according to the width of the medium M having the largest width among the plurality of types of media M, the frequency of occurrence of missing dots in the nozzle groups positioned near both ends of the liquid ejection head 22 in subsequent printing can be reduced while suppressing the amount of liquid consumed by the second idle ejection.

The control section 100 may determine the plurality of nozzles 21 constituting the second nozzle group NG2 and the third nozzle group NG3 according to the width of a type of the medium having a smallest width among the plurality of types of media M stored in the plurality of medium storing portions 16. In this case, the second idle ejection can be performed by predicting a nozzle group in which both ends may be missing. For example, when the printing data PD is received, the process of determining the nozzle group to be used for the second idle ejection is not required, and the control section 100 can start printing quickly. Since the second nozzle group NG2 and the third nozzle group NG3 are determined according to the width of the medium M having the smallest width among the plurality of types of media M, although the amount of liquid consumed in the second idle ejection increases, the frequency of occurrence of missing dots in the nozzle groups positioned near both ends of the liquid ejection head 22 in subsequent printing can be reduced more effectively.

Furthermore, the control section 100 may be configured to include the detecting portion 38 that detects the width of the medium to be transported. When a predetermined number of media M are transported, the control section 100 may determine the plurality of nozzles 21 constituting the second nozzle group NG2 and the third nozzle group NG3 according to the width of a type of the media of which number of sheets is largest among the predetermined number of sheets of the media. In this case, even if the width of the medium M used in the current printing is different from the width of the medium M frequently used in the previous printings, the appropriate second nozzle group NG2 and third nozzle group NG3, it is possible to perform the second idle ejection for ejecting the liquid from the nozzles 21 constituting the appropriate second nozzle group NG2 and third nozzle group NG3 to the second cap group and the third cap group.

The effect of this embodiment will be described.

1. The liquid ejection apparatus includes the liquid ejection head 22 configured to eject liquid from the plurality of nozzles 21 to the medium M and the plurality of caps 41 configured to cover a plurality of nozzle groups. The plurality of caps 41 includes the first cap group NG1 covering a first nozzle group positioned near the center of the liquid ejection head 22 among the plurality of nozzle groups and the second cap group and the third cap group provided at positions sandwiching the first cap group in the width direction X. The liquid ejection head 22 is configured to execute first idle ejection for ejecting liquid from the plurality of nozzles 21 constituting the plurality of nozzle groups to the plurality of caps 41 and second idle ejection for ejecting the liquid from the plurality of nozzles constituting a second nozzle group NG2 and a third nozzle group NG3 to the second cap group and the third cap group. Therefore, fresh liquid can be supplied into the cap 41, and a decrease in the moisturizing ability for moisturizing the nozzle 21 during capping can be suppressed.

2. In the liquid ejection apparatus, the amount of liquid ejected from one nozzle 21 during the second idle ejection is larger than the amount of liquid ejected from one nozzle 21 during the first idle ejection. Therefore, by performing the second idle ejection having a larger ejection amount than the first idle ejection, fresh liquid can be supplied into the cap 41, and a decrease in the moisturizing ability can be suppressed.

3. The liquid ejection apparatus according to (1) or 2, the cycle at which the second idle ejection is performed is set to be longer than the cycle at which the first idle ejection is performed. Therefore, the amount of liquid consumed by the second idle ejection can be suppressed.

4. The liquid ejection apparatus further includes the discharge mechanism 44 that discharges the liquid in the plurality of caps 41. The second idle ejection is performed after the liquid is discharged from the plurality of caps 41 by the discharge mechanism 44. Therefore, fresh liquid can be supplied into the cap 41, and a decrease in the moisturizing ability can be suppressed.

5. The liquid ejection apparatus further includes the medium storing portion 16 that stores the medium M. The plurality of nozzles 21 constituting the second nozzle group NG2 and the third nozzle group NG3 are determined according to the width of the medium M stored in the medium storing portion 16. Therefore, it is possible to perform the second idle ejection by predicting a nozzle group in which both ends may be missing.

6. In the liquid ejection apparatus, a plurality of the medium storing portions 16 are provided. The plurality of nozzles 21 constituting the second nozzle group NG2 and the third nozzle group NG3 are determined according to the width of a type of the medium M having a largest width, among a plurality of types of media M stored in the plurality of medium storing portions 16. Therefore, it is possible to perform the second idle ejection by predicting a nozzle group in which both ends may be missing. For example, when the printing data PD is received, the process of determining the nozzle group to be used for the second idle ejection is not required, and the control section 100 can start printing quickly. Further, it is possible to reduce the frequency of occurrence of missing dots in nozzle groups positioned near both ends of the liquid ejection head 22 in subsequent printing while suppressing the amount of liquid consumed by the second idle ejection.

7. In the liquid ejection apparatus, a plurality of medium storing portions 16 are provided. The plurality of nozzles 21 constituting the second nozzle group NG2 and the third nozzle group NG3 are determined according to the width of a type of the medium having a smallest width among a plurality of types of media M stored in the plurality of medium storing portions 16. Therefore, it is possible to perform the second idle ejection by predicting a nozzle group in which both ends may be missing. For example, when the printing data PD is received, the process of determining the nozzle group to be used for the second idle ejection is not required, and the control section 100 can start printing quickly. Although the amount of liquid consumed by the second idle ejection increases, the frequency of occurrence of missing dots in the nozzle groups positioned near both ends of the liquid ejection head 22 in subsequent printing can be reduced more effectively.

8. The liquid ejection apparatus further includes the detecting portion 38 that detects a width of the medium M to be transported. When a predetermined number of sheets of the media M are transported, the plurality of nozzles 21 constituting the second nozzle group NG2 and the third nozzle group NG3 are determined according to the width of a type of the media of which number of sheets is largest among the predetermined number of sheets of the media. Therefore, it is possible to perform the second idle ejection by predicting a nozzle group in which both ends may be missing. Here, the predetermined number of sheets is a number of sheets corresponding to an increase in viscosity of the nozzle 21.

9. In the liquid ejection apparatus, the liquid ejection head 22 is configured to eject black ink as liquid and color ink different from the black ink. The amount of the black ink ejected from one nozzle 21 during the second idle ejection is larger than the amount of the color ink ejected from one nozzle 21 during the second idle ejection. Therefore, consumption of the color ink can be suppressed.

The embodiment described above can be changed to a form such as the following modification example. Furthermore, a combination of the embodiment described above and the following modification examples may be used as a further modification example, or a combination of the following modification examples may be used as a further modification example.

In the embodiment described above, the medium size is acquired based on the detection result of the size sensor 19 that has detected the size of the medium M stored in the medium storing portion 16, when the medium size is specified in the printing condition information, medium size information may be acquired from the printing condition information. Then, the second nozzle group NG2 and the third nozzle group NG3 may be determined using the medium size information.

The user may operate the operation section 15 to input the medium size information.

The liquid ejection apparatus 11 may be a printer that can use only one type of medium.

In the embodiment described above, although the second nozzle group NG2 and the third nozzle group NG3 for performing the second idle ejection are determined based on the setting positions SW1 and SW2 set inside the positions of the side ends ME1 and ME2 of the medium M, the second nozzle group NG2 and the third nozzle group NG3 may be determined based on the positions of the side ends ME1 and ME2 of the medium M.

A configuration for determining the width of the medium to be printed based on the printing data PD may be adopted. For example, the width of the image or the size of the margin area on both sides in the width direction may be determined by analyzing the image data in the printing data PD, and the second nozzle group NG2 and the third nozzle group NG3 may be obtained based on the width of the image or the size of the margin area. The second nozzle group NG2 and the third nozzle group NG3 may be determined based on a value obtained by adding a predetermined margin to the size of the margin area. According to this configuration, the second nozzle group NG2 and the third nozzle group NG3 can be more appropriately determined as compared with the configuration for estimating the margin area, and thus wasteful consumption of liquid can be suppressed and the liquid in the nozzle 21 can be appropriately moisturized.

The number of nozzles 21 that perform the second idle ejection is not limited to the same number on both sides of the liquid ejection head 22 in the width direction X. For example, in the case of the liquid ejection apparatus 11 including one-sided edge guide by which the medium M is shifted to one side in the width direction X, the number of non-ejection nozzles is reduced at the end portion on the side shifted to one side in the width direction X. Therefore, the number of nozzles 21 constituting the second nozzle group NG2 may be different from the number of nozzles 21 constituting the third nozzle group NG3. For example, when the medium M is shifted to the second nozzle group NG2 side, the number of the nozzles 21 constituting the second nozzle group NG2 may be smaller than the number of the nozzles 21 constituting the third nozzle group NG3.

In the embodiment described above, if there is a non-ejection nozzle even in a part (one nozzle) of the unit nozzle group that is the area of the nozzle 21 covered by one cap 41, the unit nozzle group corresponding to the cap 41 that caps the non-ejection nozzle is targeted for the second idle ejection, but the number of non-ejection nozzles as a reference for determining a unit nozzle group targeted for the second idle discharge is not limited to one. For example, the presence or absence of two or more non-ejection nozzles may be used as a reference, or the ratio of the number of non-ejection nozzles to the number of nozzles 21 constituting a unit nozzle group may be used. It is preferable that the number of non-ejection nozzles or the ratio of non-ejection nozzles used as a reference when determining the nozzle group performing the second idle ejection is a value equal to or less than half of the number of nozzles 21 constituting a unit nozzle group covered by one cap 41. That is, a ratio of the number of nozzles related to a non-printing area including no margin or the non-printing area including the margin to the unit nozzle group corresponding to one cap may be changed as appropriate, but is preferably 0.5 or less. Of course, the ratio may be 0.6 or 0.7.

The arrangement of the unit ejection heads 27 constituting the liquid ejection head 22 can be changed as appropriate. The arrangement of the unit ejection heads is not limited to the configuration in which the unit ejection heads 27 are obliquely arranged as in the embodiment described above, and, for example, a configuration in which two rows, in which the unit ejection heads are arranged at a constant interval in the width direction X, are provided in a staggered arrangement in which the positions are shifted in the width direction by half the interval between the rows, may be adopted.

When the width of the medium M is acquired by a sensor, a configuration in which the end of the medium M is detected by a contact-type sensor or a non-contact-type sensor may be employed.

In the second idle ejection, only the black ink may be ejected without ejecting the color ink.

In the second idle ejection, the color ink does not have to be ejected every time. The color ink may be discharged only when the remaining amount of the color ink is large, or may be ejected every time the second idle ejection is performed a plurality of times.

In order to reduce the ink consumption, a configuration in which moisture is supplied to the cap 41 in addition to the second idle ejection may be provided. In this case, the cap 41 to which moisture is supplied may be all caps or only the cap 41 corresponding to the second nozzle group NG2 and the third nozzle group NG3 determined in the embodiment described above. Also in this case, it is desirable to supply moisture after the liquid is discharged from the cap 41. Further, a configuration in which the second idle ejection from the nozzle group that ejects the color ink is not performed may be adopted. In this case, in the embodiment described above, it is preferable to supply the cap with an amount of water corresponding to an ejection amount when performing the second idle ejection from the color nozzle group. At this time, it suffices to supply water of which amount is equal to or more than the amount of water in the second idle ejection amount of the color nozzle.

The medium M is not limited to paper, but may be a film or sheet made of synthetic resin, cloth, nonwoven fabric, a composite film (laminated sheet) of synthetic resin and metal, metal foil, ceramic sheet, or the like.

The liquid ejected by the liquid ejection head 22 is not limited to ink, but may be, for example, a liquid material in which particles of a functional material are dispersed or mixed in the liquid. For example, the liquid ejection head 22 may eject a liquid material containing a material such as an electrode material or a pixel material used for manufacturing a liquid crystal display, an electroluminescence display, a surface-emitting display, or the like in a dispersed or dissolved form. The liquid solvent or dispersion medium is not limited to water, but may be an organic solvent.

The liquid ejection apparatus 11 is not limited to an ink jet printer, but may be an ink jet textile printing function section. Further, the liquid ejection apparatus 11 is not limited to a line printer, but may be a page printer.

Hereinafter, the technical ideas grasped from the embodiment described above and modification examples will be described together with effects.

A liquid ejection apparatus includes a liquid ejection head configured to extend in a width direction that intersects a transport direction of a medium and eject liquid from a plurality of nozzles constituting a plurality of nozzle groups to the medium and a plurality of caps configured to cover the plurality of nozzle groups, and the plurality of caps includes a first cap group covering a first nozzle group positioned near the center of the liquid ejection head among the plurality of nozzle groups and a second cap group and a third cap group provided at positions sandwiching the first cap group in the width direction and the liquid ejection head is configured to execute a first idle ejection for ejecting liquid from the plurality of nozzles constituting the plurality of nozzle groups to the plurality of caps and a second idle ejection for ejecting the liquid from the plurality of nozzles constituting the second nozzle group and the third nozzle group to the second cap group and the third cap group.

According to this configuration, fresh liquid can be supplied into the cap, and a decrease in the moisturizing ability can be suppressed.

In the liquid ejection apparatus, an amount of liquid ejected from one nozzle during the second idle ejection may be larger than the amount of liquid ejected from one nozzle during the first idle ejection.

According to this configuration, fresh liquid can be supplied into the cap by performing the second idle ejection having a larger ejection amount than the first idle ejection, and a decrease in the moisturizing ability can be suppressed.

In the liquid ejection apparatus, a cycle at which the second idle ejection is performed is set to be longer than the cycle at which the first idle ejection is performed. According to this configuration, the amount of liquid consumed by the second idle ejection can be suppressed.

The liquid ejection apparatus further includes a discharge mechanism that discharges the liquid in the plurality of caps, and the second idle ejection may be executed after the liquid is discharged from the plurality of caps by the discharge mechanism.

According to this configuration, fresh liquid can be supplied into the cap, and a decrease in the moisturizing ability can be suppressed.

The liquid ejection apparatus further includes a medium storing portion that stores the medium and the plurality of nozzles constituting the second nozzle group and the third nozzle group may be determined according to a width of the medium stored in the medium storing portion.

According to this configuration, the second idle ejection can be performed by predicting a nozzle group in which both ends may be missing.

In the liquid ejection apparatus, a plurality of the medium storing portions are provided, and the plurality of nozzles constituting the second nozzle group and the third nozzle group may be determined according to the width of a type of the medium having a largest width, among a plurality of types of media stored in the plurality of medium storing portions.

According to this configuration, the second idle ejection can be performed by predicting a nozzle group in which a nozzle group in which both ends may be missing.

In the liquid ejection apparatus, a plurality of the medium storing portions are provided, and the plurality of nozzles constituting the second nozzle group and the third nozzle group may be determined according to the width of a type of the medium having a smallest width, among a plurality of types of media stored in the plurality of medium storing portions.

According to this configuration, it is possible to perform the second idle ejection by predicting a nozzle group in which both ends may be missing.

The liquid ejection apparatus further includes a detecting portion that detects a width of the medium to be transported and, when a predetermined number of sheets of the media are transported, the plurality of nozzles constituting the second nozzle group and the third nozzle group may be determined according to the width of a type of the media of which number of sheets is largest among the predetermined number of sheets of the media.

According to this configuration, it is possible to perform the second idle ejection by predicting a nozzle group in which both ends may be missing. Here, the predetermined number is a number corresponding to an increase in viscosity of the nozzle.

In the liquid ejection apparatus, the liquid ejection head is configured to eject black ink as the liquid and a color ink different from the black ink, and an amount of the black ink ejected from one nozzle during the second idle ejection is larger than the amount of the color ink ejected from one nozzle during the second idle ejection.

According to this configuration, consumption of the color ink can be suppressed.

What is claimed is:

1. A liquid ejection apparatus comprising:

a liquid ejection head that extends in a width direction that intersects a transport direction of a medium and performs printing by ejecting liquid from a plurality of nozzles constituting a plurality of nozzle groups to the medium; and a plurality of caps configured to cover the plurality of nozzle groups, wherein the plurality of caps includes a first cap group covering a first nozzle group positioned near the center of the liquid ejection head among the plurality of nozzle groups and a second cap group and a third cap group provided at positions sandwiching the first cap group in the width direction, and the liquid ejection head is configured to execute a first idle ejection for ejecting liquid from the plurality of nozzles constituting the plurality of nozzle groups to the plurality of caps and a second idle ejection for ejecting the liquid from the plurality of nozzles constituting the second nozzle group and the third nozzle group to the second cap group and the third cap group, the plurality of nozzles constituting the second nozzle group and the third nozzle group include non-ejection nozzles that are not used for printing that precedes the second idle ejection.

2. The liquid ejection apparatus according to claim 1, wherein an amount of liquid ejected from one nozzle during the second idle ejection is larger than an amount of liquid ejected from one nozzle during the first idle ejection.

3. The liquid ejection apparatus according to claim 1, wherein a cycle at which the second idle ejection is performed is set to be longer than the cycle at which the first idle ejection is performed.

4. The liquid ejection apparatus according to claim 1, further comprising:

a discharge mechanism that discharges the liquid in the plurality of caps, wherein the second idle ejection is executed after the liquid is discharged from the plurality of caps by the discharge mechanism.

5. The liquid ejection apparatus according to claim 1, further comprising:

a medium storing portion that stores the medium, wherein the plurality of nozzles constituting the second nozzle group and the third nozzle group are determined according to a width of the medium stored in the medium storing portion.

6. The liquid ejection apparatus according to claim 5, wherein a plurality of the medium storing portions are provided, and the plurality of nozzles constituting the second nozzle group and the third nozzle group are determined according to the width of the medium of a type having a largest width, among a plurality of types of media stored in the plurality of medium storing portions.

7. The liquid ejection apparatus according to claim 5, wherein a plurality of the medium storing portions are provided, and the plurality of nozzles constituting the second nozzle group and the third nozzle group are determined according to the width of the medium of a type having a smallest width, among a plurality of types of media stored in the plurality of medium storing portions.

8. The liquid ejection apparatus according to claim 1, further comprising:

a detecting portion that detects a width of the medium to be transported, wherein when a predetermined number of sheets of the media are transported, the plurality of nozzles constituting the second nozzle group and the third nozzle group are determined according to the width of a type of the media of which the number of sheets is largest among the predetermined number of sheets of the media.

9. The liquid ejection apparatus according to claim 1, wherein the liquid ejection head is configured to eject, as the liquid, black ink and a color ink different from the black ink, and an amount of the black ink ejected from one nozzle during the second idle ejection is larger than an amount of the color ink ejected from one nozzle during the second idle ejection.

10. A liquid ejection apparatus comprising:

a liquid ejection head configured to extend in a width direction that intersects a transport direction of a medium and eject liquid from a plurality of nozzles constituting a plurality of nozzle groups to the medium;

a plurality of caps configured to cover the plurality of nozzle groups; and a medium storing portion that stores the medium, wherein the plurality of caps includes a first cap group covering a first nozzle group positioned near the center of the liquid ejection head among the plurality of nozzle groups and a second cap group and a third cap group provided at positions sandwiching the first cap group in the width direction, the liquid ejection head is configured to execute a first idle ejection for ejecting liquid from the plurality of nozzles constituting the plurality of nozzle groups to the plurality of caps and a second idle ejection for ejecting the liquid from the plurality of nozzles constituting the second nozzle group and the third nozzle group to the second cap group and the third cap group, and the plurality of nozzles constituting the second nozzle group and the third nozzle group are determined according to a width of the medium stored in the medium storing portion.

11. A liquid ejection apparatus comprising:

a liquid ejection head configured to extend in a width direction that intersects a transport direction of a medium and eject liquid from a plurality of nozzles constituting a plurality of nozzle groups to the medium;

a plurality of caps configured to cover the plurality of nozzle groups; and a detecting portion that detects a width of the medium to be transported, wherein the plurality of caps includes a first cap group covering a first nozzle group positioned near the center of the liquid ejection head among the plurality of nozzle groups and a second cap group and a third cap group provided at positions sandwiching the first cap group in the width direction, the liquid ejection head is configured to execute a first idle ejection for ejecting liquid from the plurality of nozzles constituting the plurality of nozzle groups to the plurality of caps and a second idle ejection for ejecting the liquid from the plurality of nozzles constituting the second nozzle group and the third nozzle group to the second cap group and the third cap group, and when a predetermined number of sheets of the media are transported, the plurality of nozzles constituting the second nozzle group and the third nozzle group are determined according to the width of a type of the media of which the number of sheets is largest among the predetermined number of sheets of the media.

* * * * *